US008517176B2

(12) United States Patent
Baker et al.

(10) Patent No.: US 8,517,176 B2
(45) Date of Patent: Aug. 27, 2013

(54) STACKABLE CONTAINER

(75) Inventors: Gerald Baker, Wauwatosa, WI (US); Thomas Murphy, Lake Mills, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 941 days.

(21) Appl. No.: 12/495,480

(22) Filed: Jun. 30, 2009

(65) Prior Publication Data

US 2010/0025281 A1 Feb. 4, 2010

Related U.S. Application Data

(60) Provisional application No. 61/085,273, filed on Jul. 31, 2008.

(51) Int. Cl.
*B65D 21/00* (2006.01)

(52) U.S. Cl.
USPC ..... 206/509; 206/503; 220/623

(58) Field of Classification Search
USPC ..... 206/509, 508, 503, 512, 610, 621, 206/623, 380, 619; 220/406, 380, 623, 621, 220/610, 508, 507, 509, 619
See application file for complete search history.

(56) References Cited

U.S. PATENT DOCUMENTS

| | | | | |
|---|---|---|---|---|
| 163,747 | A | 5/1875 | Cummings | |
| 2,245,430 | A * | 6/1941 | Courtright et al. | 285/202 |
| 2,288,182 | A * | 6/1942 | Curtin | 220/62.12 |
| 2,310,420 | A | 2/1943 | Graham | |
| 2,833,452 | A | 5/1958 | Drummond et al. | |
| 2,899,096 | A * | 8/1959 | Henchert | 220/4.27 |
| 3,279,640 | A | 10/1966 | Dodson | |
| 3,288,342 | A | 11/1966 | Tinker | |
| 3,389,830 | A | 6/1968 | Smith | |
| 3,429,475 | A | 2/1969 | Scholtz | |
| 3,557,999 | A | 1/1971 | Chagoyen | |
| 4,199,073 | A | 4/1980 | Gombas | |
| 4,363,404 | A | 12/1982 | Westphal | |
| 4,454,742 | A | 6/1984 | Gombas | |
| 4,646,930 | A | 3/1987 | Karas et al. | |
| 4,707,213 | A | 11/1987 | Mohr et al. | |
| 4,744,465 | A | 5/1988 | Parker | |
| 4,754,113 | A | 6/1988 | Mohr et al. | |
| 4,967,538 | A | 11/1990 | Leftault, Jr. et al. | |
| 5,000,905 | A | 3/1991 | Cox et al. | |
| 5,109,653 | A | 5/1992 | Kubis et al. | |
| 5,163,073 | A | 11/1992 | Chasteen et al. | |
| 5,169,017 | A | 12/1992 | Cooper et al. | |
| 5,188,497 | A | 2/1993 | Hantelmann et al. | |
| 5,226,518 | A | 7/1993 | Purcell et al. | |
| 5,249,448 | A | 10/1993 | Fedor et al. | |
| 5,368,176 | A | 11/1994 | Thanisch | |

(Continued)

*Primary Examiner* — Anthony Stashick
*Assistant Examiner* — Kevin Castillo
(74) *Attorney, Agent, or Firm* — Reinhart Boerner Van Deuren s.c.

(57) ABSTRACT

A container configured to be stacked adjacent to a second container is provided. The container includes a sidewall having a first end, an end wall having a peripheral edge, a seam coupling the peripheral edge of the end wall to the first end of the sidewall, and an alignment feature coupled to the seam. The alignment feature includes an inner surface. The alignment feature is positioned relative to the seam such that, when the container is stacked adjacent to the second container, the inner surface of the alignment feature contacts an outer surface of a seam of the second container, the contact resisting lateral movement of the container relative to the second container.

16 Claims, 15 Drawing Sheets

(56) References Cited

U.S. PATENT DOCUMENTS

| | | | | |
|---|---|---|---|---|
| 5,392,803 | A | | 2/1995 | Bruce |
| 5,421,480 | A | | 6/1995 | Cudzik |
| 5,448,903 | A | | 9/1995 | Johnson |
| 5,504,271 | A | | 4/1996 | Curtis et al. |
| 5,542,277 | A | | 8/1996 | Dunwoody |
| 5,549,468 | A | | 8/1996 | Mitchell et al. |
| 5,573,133 | A | | 11/1996 | Park |
| 5,597,284 | A | | 1/1997 | Weltlich et al. |
| 5,617,755 | A | | 4/1997 | Cheers et al. |
| 5,669,523 | A | | 9/1997 | Mueller et al. |
| 5,680,952 | A | | 10/1997 | Chasteen |
| 5,688,466 | A | | 11/1997 | Mitchell et al. |
| 5,692,409 | A | | 12/1997 | Cheers et al. |
| 5,740,914 | A | | 4/1998 | Herzog |
| 5,809,860 | A | | 9/1998 | Haaser |
| 6,071,048 | A | | 6/2000 | Powell et al. |
| 6,082,541 | A | * | 7/2000 | Bewick ..... 206/508 |
| 6,126,029 | A | * | 10/2000 | Storgaard ..... 220/271 |
| 6,206,222 | B1 | | 3/2001 | Cudzik |
| 6,230,912 | B1 | | 5/2001 | Rashid |
| 6,293,422 | B1 | | 9/2001 | Jentzsch et al. |
| 6,294,131 | B1 | | 9/2001 | Jaffrey |
| 6,341,709 | B1 | | 1/2002 | Wilson |
| 6,351,980 | B1 | | 3/2002 | Jowitt et al. |
| D485,765 | S | | 1/2004 | Thierjung et al. |
| 6,974,046 | B2 | | 12/2005 | Shenkar |
| 7,003,999 | B2 | | 2/2006 | Campo et al. |
| 7,014,075 | B2 | | 3/2006 | Bonifacio et al. |
| 2007/0102425 | A1 | | 5/2007 | Richardson et al. |
| 2007/0108196 | A1 | | 5/2007 | Richardson et al. |
| 2007/0108197 | A1 | | 5/2007 | Richardson et al. |
| 2007/0108198 | A1 | | 5/2007 | Richardson et al. |
| 2008/0302799 | A1 | | 12/2008 | Moore et al. |
| 2010/0025279 | A1 | | 2/2010 | Baker et al. |

* cited by examiner

STACKABLE CONTAINER

CROSS-REFERENCE TO RELATED PATENT APPLICATION

This application claims the benefit of U.S. Provisional Application No. 61/085,273, filed Jul. 31, 2008, which is expressly incorporated herein by reference in its entirety.

FIELD OF THE INVENTION

The present invention relates generally to containers. In particular, the present invention relates to containers having features that provide stacking properties.

BACKGROUND OF THE INVENTION

Containers are used to store a variety of materials, and containers must often meet a wide variety of requirements depending on the intended use. In particular, containers that store perishable materials, such as foods, drinks, pet foods, etc., typically should be able to maintain an airtight seal after the container is filled in order to prevent spoilage of the contents of the container. For example, in the case of metal food cans, the integrity of the can body, the can end walls, and the seams should be maintained during manufacture, filling, cooking, processing, labeling, shipping, displaying, purchasing, home storage, etc. Containers designed to be stacked on top of each other typically should perform all of the functions of non-stackable containers.

Food and beverage containers typically will have at least one closure or can end. One type of food and beverage container is provided with a can end affixed to the container by folding or crimping material that is coupled to the can end with the material of the container body to create a seam such as a double seam. Such can ends may require the use of a tool, such as a can opener, to remove the can end. Other can ends (e.g., "pop-tops", "pull tops", easy open ends, converted ends, convenience ends, convenience lids, etc.) may be provided with a ring or tab that allows the can end to be removed without the use of a tool. Such a can end may include a structure (e.g., a score, thin connecting metal, etc.) that provides a weakness in the can end that aids in the removal of the can end. In addition, the can end may be a thin sheet of material (e.g., metal foil, etc.) coupled to the container through the use of an adhesive or other mechanism. Other types of food or beverage containers include closures that are affixed to the container primarily by the pressure differential between external atmospheric pressure and a lower internal pressure. Other types of closures (e.g., twist on/off closures, snap on/twist off closures, etc.) are affixed to the container mechanically.

During certain processes, containers are filled with hot, pre-cooked food then sealed for later consumption, commonly referred to as a "hot fill process." As the contents of the container cool, a vacuum develops inside the container. The resulting vacuum may partially or completely secure the closure to the body of the container. Foods packed with a hot fill process often have certain advantages. For example, end-users often appreciate the convenience of pre-cooked food contents as preparation times are often shorter.

During other processes, containers are filled with uncooked food, sealed, and the food, while in the sealed container, is cooked to the point of being commercially sterilized or "shelf stable." This process is commonly called a thermal process. During such a process, the required heat may be delivered by a pressurized device, or retort. Thermal processes also have certain advantages. First, the resulting shelf-stable package offers long-term storage of food in a hermetically sealed container. Second, cooking the food inside the container commercially sterilizes the food and the container at the same time. In addition, during some cooking procedures, multiple cans are pushed end to end to move the cans through the heating device. In other processes, metal food cans are rolled to facilitate movement of the cans through the process.

Containers may be stacked for a variety of reasons such as improved display, storage, transport, etc. of the containers. Accordingly, it would be desirable to provide a container having one or more features that provide improved stacking properties.

SUMMARY OF THE INVENTION

One embodiment of the invention relates to a container adapted to be stacked adjacent to a second container. The container includes a sidewall, the sidewall having a first end and a second end, a first end wall, and a first seam coupling the first end wall to the first end of the sidewall. The first seam includes an inner segment extending in the longitudinal direction away from the first end wall, an outer segment, and a shoulder segment, the shoulder segment extending in the radial direction. The container also includes an alignment feature extending in the longitudinal direction away from the first end wall. The alignment feature includes an inner segment having an inner surface and an outer segment. The inner segment of the first seam is coupled to and positioned between the first end wall and the shoulder segment. The shoulder segment is coupled to and positioned between the inner segment of the first seam and the inner segment of the alignment feature. The inner segment of the alignment feature is coupled to and positioned between the shoulder segment and the outer segment of the alignment feature. The outer segment of the alignment feature is coupled to and positioned between the inner segment of the alignment feature and the outer segment of the first seam. The outer segment of the first seam is coupled to and positioned between the outer segment of the alignment feature and the first end of the sidewall. The alignment feature resists lateral movement of the container relative to the second container via contact between the inner surface of the alignment feature and the second container, when the container is stacked adjacent to the second container.

Another embodiment of the invention relates to a container configured to be stacked adjacent to a second container. The container includes a sidewall having a first end, an end wall having a peripheral edge, a seam coupling the peripheral edge of the end wall to the first end of the sidewall, and an alignment feature coupled to the seam. The alignment feature includes an inner surface. The alignment feature is positioned relative to the seam such that, when the container is stacked adjacent to the second container, the inner surface of the alignment feature contacts an outer surface of a seam of the second container, the contact resisting lateral movement of the container relative to the second container.

Another embodiment of the invention relates to a stack of containers including a first container and a second container. The first container includes a body sidewall having a first end, an end wall, a seam coupling the end wall of the first container to the first end of the body sidewall of the first container, and an annular rim coupled to the seam of the first container. The annular rim includes an inner surface. The second container includes a second container including a body sidewall having a second end, an end wall, and a seam coupling the end wall of the second container to the second end of the body sidewall of second container. The seam includes an outer surface. When the first container is placed adjacent to the second container, the seam of the second container is received within the annular rim, and contact between the inner surface of the annular rim and the outer surface of the seam of the second container resists lateral movement of the first container relative to the second container.

Another embodiment of the invention relates to a metal can end, which, when joined to a cylindrical can sidewall having at least one outside sidewall radius, is capable of preventing lateral movement between at least two stacked cans. The metal can end includes an end wall having an end radius less than the sidewall radius and a first metal band joined at substantially a right angle to the end wall and having a first radius less than the sidewall radius. The metal can end also includes a second metal band generally concentric with the first metal band and having a second radius substantially the same as the outside sidewall radius and a third metal band joined to the second metal band, generally concentric with the first and second bands and having a third radius. The metal can end also includes a fourth metal band joined to the first metal band at an angle in a range of 90 to 160 degrees relative to the end wall and having a fourth radius greater than the third radius and a fifth metal band joined to the third and fourth metal bands and being generally concentric with the fourth metal band.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION OF THE PREFERRED EMBODIMENTS

Referring generally to the FIGS., a container, shown as a metal food can, is depicted having an alignment feature that aligns the container relative to a second container and that prevents lateral movement of the container relative to the second container when the container is stacked on top of the second container. The containers discussed herein may be used to hold perishable materials (e.g. food, drink, pet food, etc.). However, the alignment features discussed herein may be used with a container of any style, shape, size, etc., or with a container that holds materials other than perishable materials.

Figure 1:
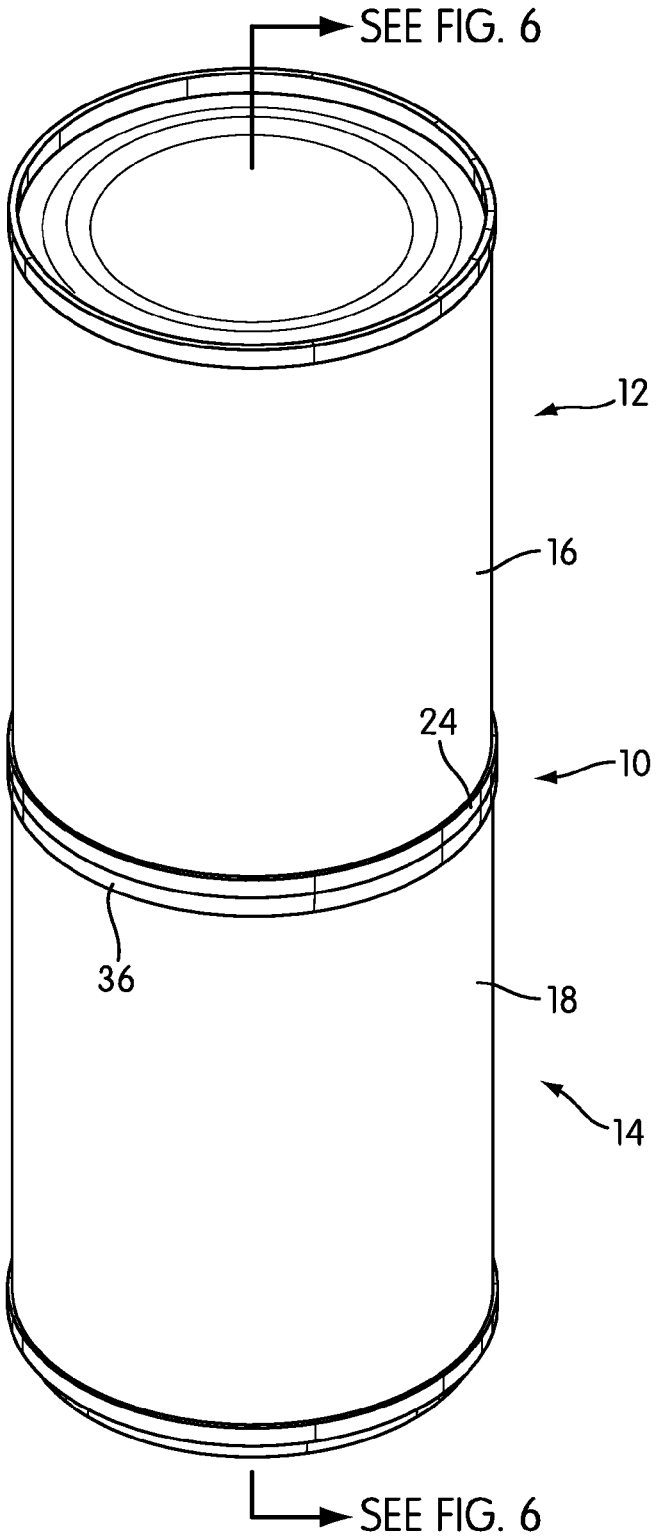
FIG. 1 shows a perspective view of a stack of two food cans according to an exemplary embodiment.

Referring to FIG. 1, a perspective view of a stack of containers, shown as stack 10, is depicted according to an exemplary embodiment. Stack 10 includes a first container, shown as upper can 12, and a second container, shown as lower can 14. Upper can 12 includes a sidewall (e.g., can body, container body, sidewall, etc), shown as body sidewall 16. Lower can 14 includes a sidewall, shown as body sidewall 18. In the exemplary embodiment of FIG. 1, body sidewall 16 and body sidewall 18, are shaped as cylinders having circular cross-sections. However, body sidewall 16 and/or body sidewall 18 may be shaped in a variety of ways (e.g., a cylinder having a non-circular cross-section, having other non-polygonal cross-sections, as a rectangular prism, a polygonal prism, any number of irregular shapes, etc.) as may be desirable for different applications or aesthetic reasons.

FIG. 1 shows upper can 12 stacked on top of lower can 14. Upper can 12 and/or lower can 14 includes one or more alignment features that aligns upper can 12 relative to lower can 14. As shown in FIG. 1, when upper can 12 and lower can 14 are positioned to create stack 10, upper can 12 is aligned relative to lower can 14 such that the longitudinal axes of upper can 12 and lower can 14 are in substantial alignment. In other embodiments, upper can 12 may be positioned relative to lower can 14 such that the longitudinal axes of upper can 12 and lower can 14 are not in substantial alignment. While only two cans are shown forming stack 10 in FIG. 1, one or more cans may be stacked below lower can 14 and/or above upper can 12.

Figure 2:
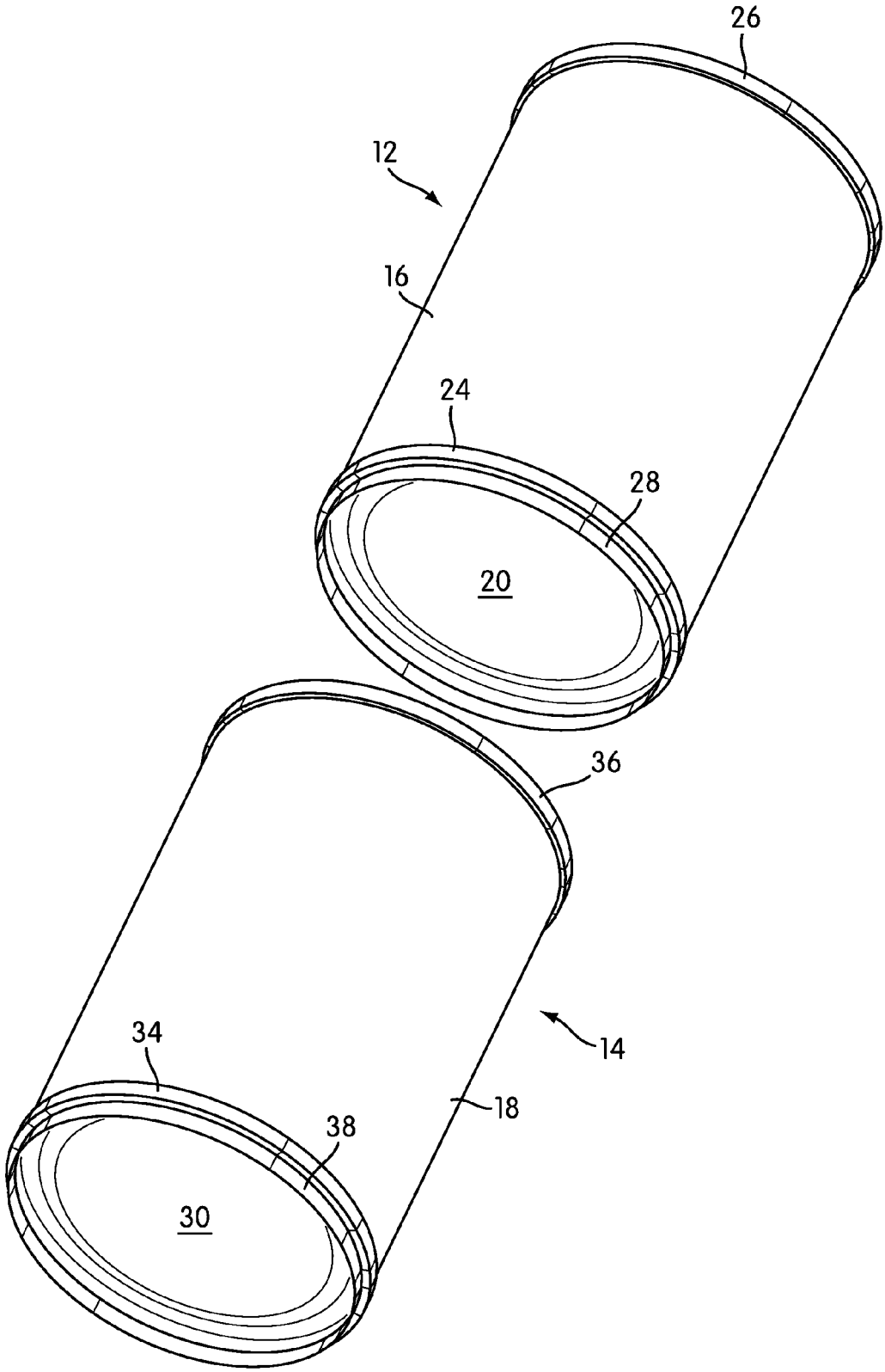
FIG. 2 shows a perspective view from below of the two food cans of FIG. 1 prior to being stacked on top of each other.
Figure 3:
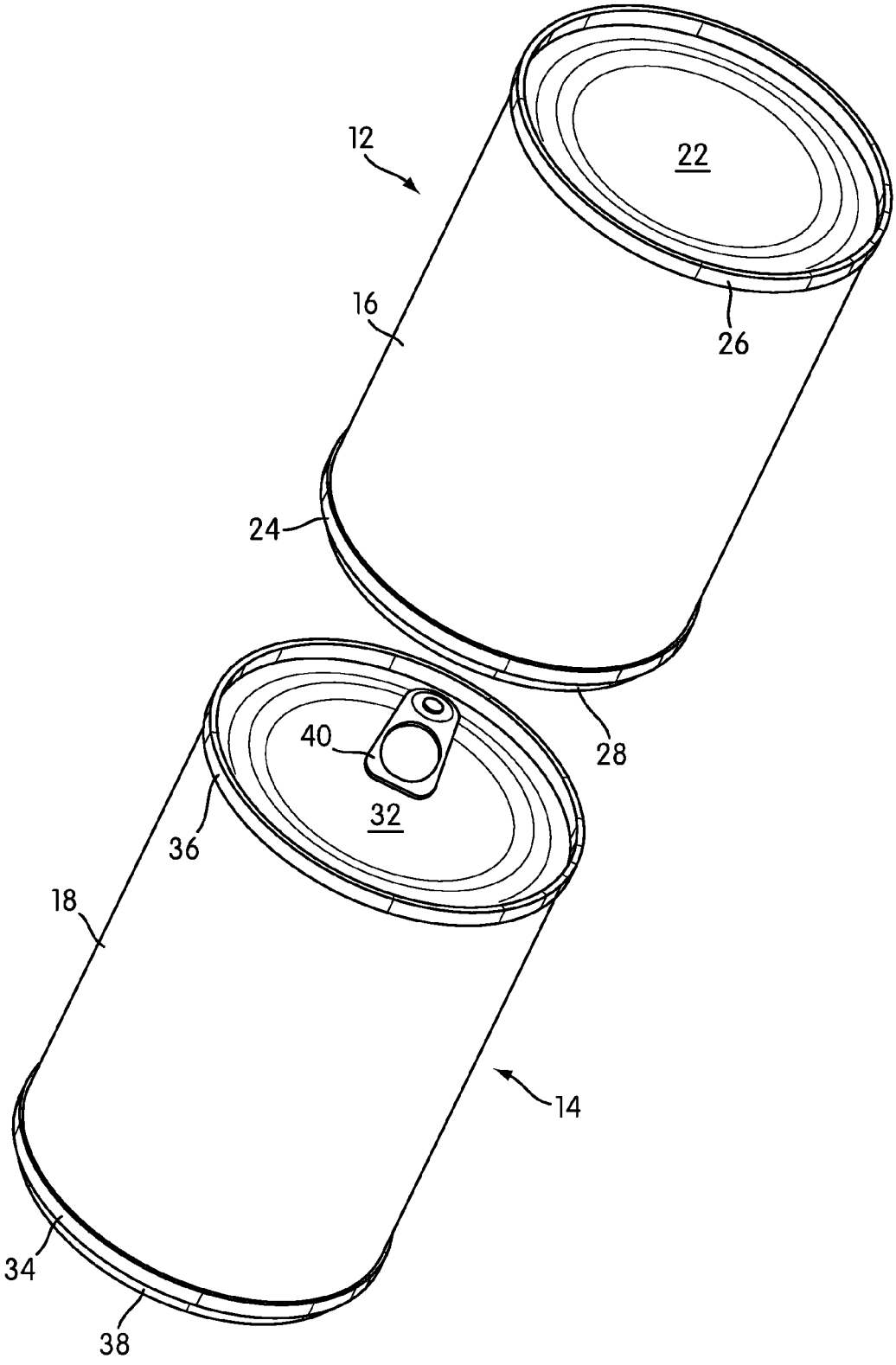
FIG. 3 shows a perspective view from above of the two food cans of FIG. 1 prior to being stacked on top of each other.

Referring to FIGS. 2 and 3, upper can 12 and lower can 14 are shown prior to creation of stack 10. Upper can 12 includes a first end wall (e.g., cover, lid, closure, etc.), shown as lower can end 20, and a second end wall, shown as upper can end 22 coupled to body sidewall 16. Upper can 12 includes a first bead or seam, shown as lower double seam 24, positioned along the peripheral edge of lower can end 20. Upper can 12 also includes a second bead or seam, shown as upper double seam 26. Lower double seam 24 couples lower can end 20 to a first end of the sidewall, shown as the lower end of body sidewall 16, and upper double seam 26 couples upper can end 22 to a second end of the sidewall, shown as the upper end of body sidewall 16. The seam or bead may be any of a number of structures such as welds, solders, mechanical attachments, etc. In addition, upper can 12 includes an alignment feature, shown as annular rim 28, extending from (e.g., positioned on, located on, etc.) lower double seam 24 and extending away from lower can end 20.

Lower can 14 includes a first end wall, shown as lower can end 30, and a second end wall, shown as upper can end 32. Lower can 14 includes a first bead or seam, shown as lower double seam 34, and a second bead or seam, shown as upper double seam 36. Lower double seam 34 couples lower can end 30 to a lower end of body sidewall 18, and upper double seam 36 couples upper can end 32 to an upper end of body sidewall 18. In addition, lower can 14 includes an alignment feature, shown as annular rim 38, positioned on lower double seam 34 and extending away from lower can end 30.

In FIGS. 2 and 3, lower can end 20, upper can end 22, and lower can end 30 are shown as conventional sanitary can ends (i.e., can ends attached to the body sidewall via a double seam and that typically require a tool, such as a can opener to remove). Upper can end 32 of lower can 14 includes a tab, shown as pull-tab 40. Pull-tab 40 allows upper can end 32 to be removed without a tool such as a can-opener. Upper can end 32 may also include structures (e.g., a score, thin connecting metal, etc.) that provides a weakness that aids in the removal of upper can end 32. In an exemplary embodiment, upper can end 32 may be an "EZO" convenience end, sold under the trademark "Quick Top" by Silgan Containers Corp. In another embodiment, upper can end 22 and/or upper can end 32 may be a closure or lid attached to the respective body sidewall mechanically (e.g., snap on/off closures, twist on/off closures, tamper-proof closures, snap on/twist off closures, etc.) or via an internal vacuum.

In one embodiment upper can 12 and lower can 14 are adapted to be filled with perishable materials, such as food, pet food, drink, milk-based products, etc. In these embodiments, the can ends, double seams, and body sidewalls of upper can 12 and lower can 14 are adapted to maintain a hermetic seal after the container is filled and sealed.

While upper can end 32 is shown including a tab, the upper and/or lower can ends of any can in stack 10 may include a tab. In one exemplary embodiment, each can in stack 10 has one sanitary can end and one can end having a tab. In another embodiment, each can in stack 10 has two sanitary can ends. In another embodiment, each can in stack 10 is configured the same as the other cans (e.g., each can may have a lower can end that is a sanitary end and an upper can end having a tab). In this embodiment, the configuration of a particular can does not depend on its intended position in the stack. The various components of lower can 14 and upper can 12 may be made of aluminum, steel, various plastics, glass, ceramics, or any suitable material.

In one embodiment, one or more end wall of each container may be made of a metal foil, plastic, or other suitable material coupled to the body sidewall with an adhesive. In an exemplary embodiment, a container end wall (e.g., upper can end 22 or upper can end 32) may include a thin sheet or membrane attached to a flange or lip extending from the inner surface of the container body. The flange may be perpendicular to the inner surface of the container. In other exemplary embodiments, the flange may extend from the inner surface of the container such that the flange forms an angle greater than or less than 90 degrees with the inner surface of the container body. According to this embodiment, the container end may be attached to the lip or flange with an adhesive or other suitable material such that the container end seals the container.

Both upper can 12 and lower can 14 shown in FIGS. 1-3 are three piece cans (i.e., cans formed from two can end components and a sidewall piece). The body sidewall of a three piece can is formed from a single rectangular strip of metal that is rolled into a cylinder and opposing edges of the rectangular strip are welded together such that the body sidewall forms a cylinder or tube that is open at both ends. A side seam is formed where opposing edges of the rectangular strip are welded together. The two end walls of the container are formed by coupling the two can end components of the three piece can to the body sidewall by formation of a bead or seam, such as a double seam.

In another embodiment, upper can 12 and/or lower can 14 may be a two piece can (i.e., a can including a body and an end wall that are integrally formed and a separate can end component). The body sidewall of a two piece can may be integrally formed from a single piece of material. A bead may be positioned along the peripheral edge of the integrally formed end wall near the transition to the vertical surface of the body sidewall. The separate can end component is coupled to the end of the body sidewall opposite the integrally formed end wall. This may be accomplished via a seam such as a double seam.

Upper can 12 and lower can 14 may be various sized cans (e.g., 3 oz., 8 oz., 12 oz., 15 oz., etc.). In one embodiment, upper can 12 and lower can 14 have a height of approximately 4.5 inches. In another embodiment, the diameter of each can end of upper can 12 and lower can 14 is approximately 3 inches. In another embodiment, each can end of upper can 12 and lower can 14 is a standard 300 diameter can end.

Figure 4:
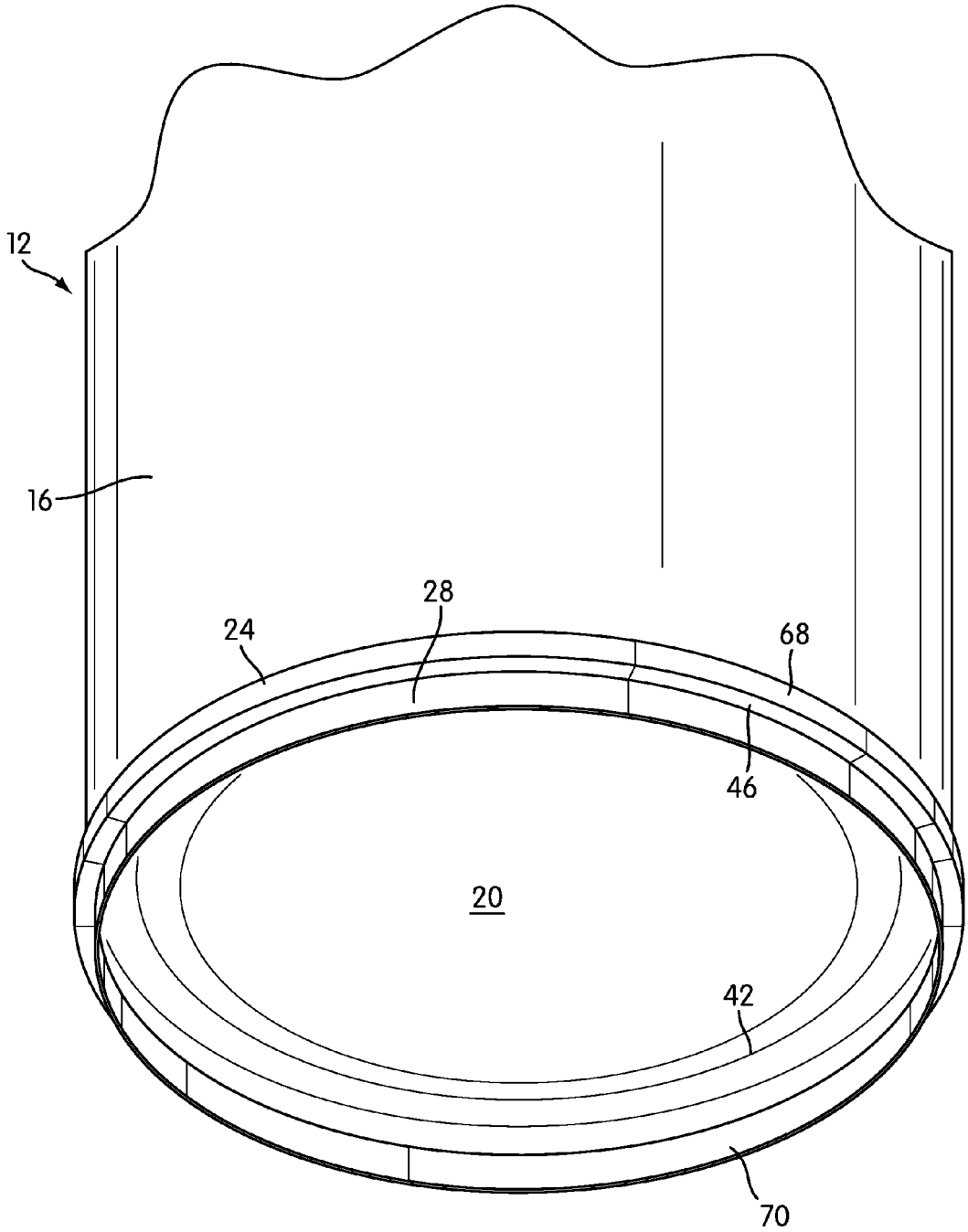
FIG. 4 shows a perspective view of a portion of a can including an alignment feature according to an exemplary embodiment.

Referring to FIG. 4, a close up view of the lower portion of upper can 12 is shown. Lower double seam 24 includes a shoulder, shown as substantially horizontal shoulder 46. As shown in FIG. 4, upper can 12 includes an alignment feature, shown as annular rim 28, extending from substantially horizontal shoulder 46 of lower double seam 24 and extending away from lower can end 20. In addition, as shown in FIG. 4, the inner surface of annular rim 28 forms a continuous vertical surface with inner surface 70 of lower double seam 24. As shown in FIG. 4, the continuous vertical surface is perpendicular to lower can end 20.

The alignment feature may be any feature or features that facilitate stacking by aligning one container in the stack relative to another container and/or that acts to resist or prevent lateral movement of one container in the stack relative to another container. For example, annular rim 28 may include one or more cutout portion. In another embodiment, the alignment feature may include one or more portions of material extending from the bead or seam positioned at one end of the container.

As shown in FIG. 4, lower can end 20 includes a series of concentric beads 42. Concentric beads 42 are adapted to allow lower can end 20 to expand outward during the heating steps of certain processes, such as cooking or sterilization processes. Concentric beads 42 allow for expansion during processes in which the can is heated after being filled and sealed. This expansion may prevent upper can 12 from rupturing due to increased pressure caused by heating. In one embodiment, each end wall of each container in stack 10 includes one or more concentric beads similar to concentric beads 42. In another embodiment, the can ends of the containers of stack 10 include no concentric beads. In another embodiment, the lower portion of each can in stack 10 is constructed the same as the lower portion of upper can 12.

Figure 5:
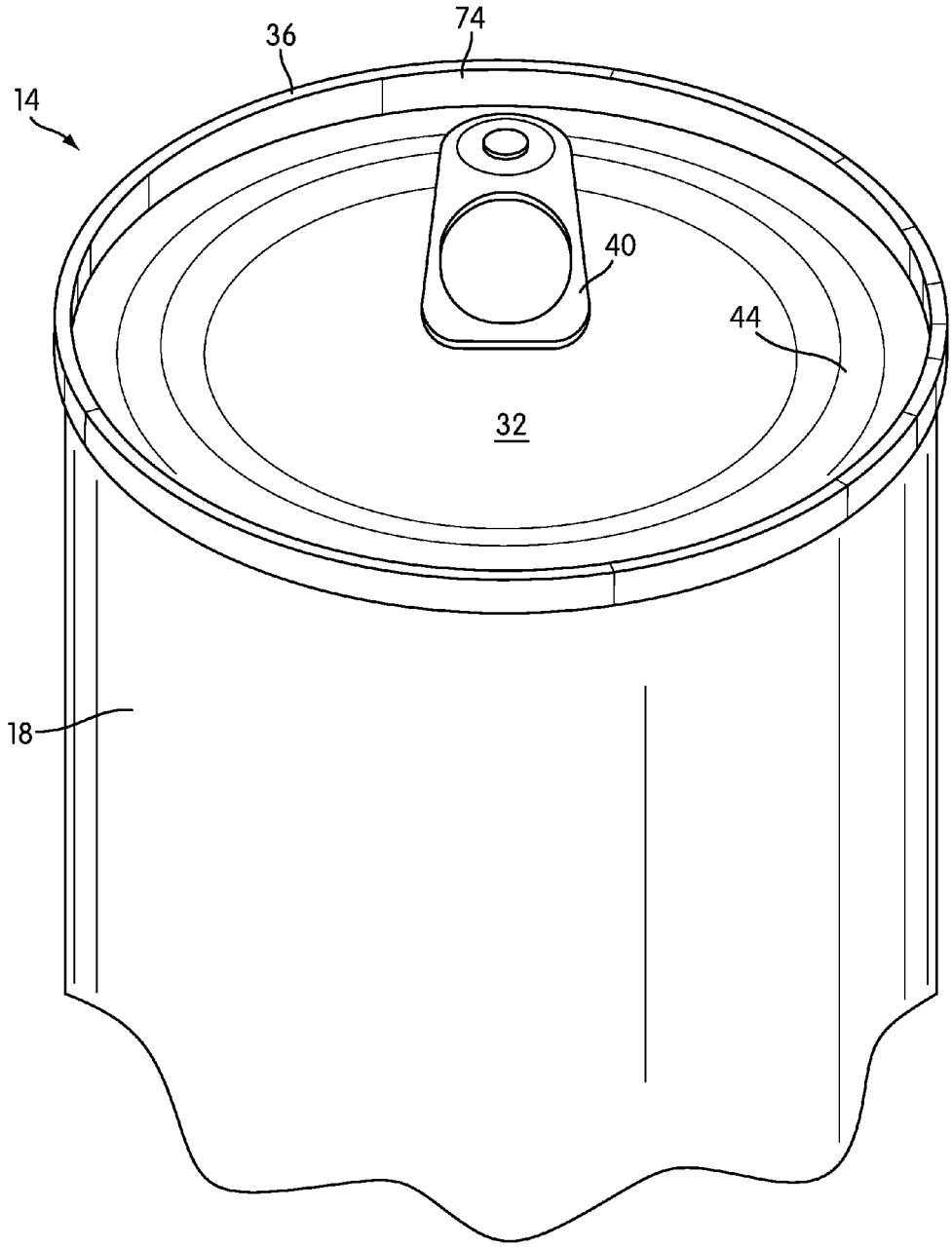
FIG. 5 shows a perspective view of a portion of a can adapted to receive an alignment feature according to an exemplary embodiment.

Referring to FIG. 5, a close up view of the upper portion of lower can 14 is shown. Upper can end 32 includes pull-tab 40 and a series of concentric beads 44. Upper can end 32 is substantially perpendicular to the vertical or longitudinal axis of body sidewall 18. Concentric beads 44 are positioned on upper can end 32. Upper can end 32 is substantially perpendicular to inner surface 74 of upper double seam 36. Concentric beads 44 function the same way as concentric beads 42. As can be seen in FIG. 5, upper can end 32 is countersunk relative to upper double seam 36. In one embodiment, the upper portion of each can in stack 10 is constructed the same as the upper portion of lower can 14. In another embodiment, the upper portion of each can in stack 10 is constructed the same as the upper portion of upper can 12.

Figure 6:
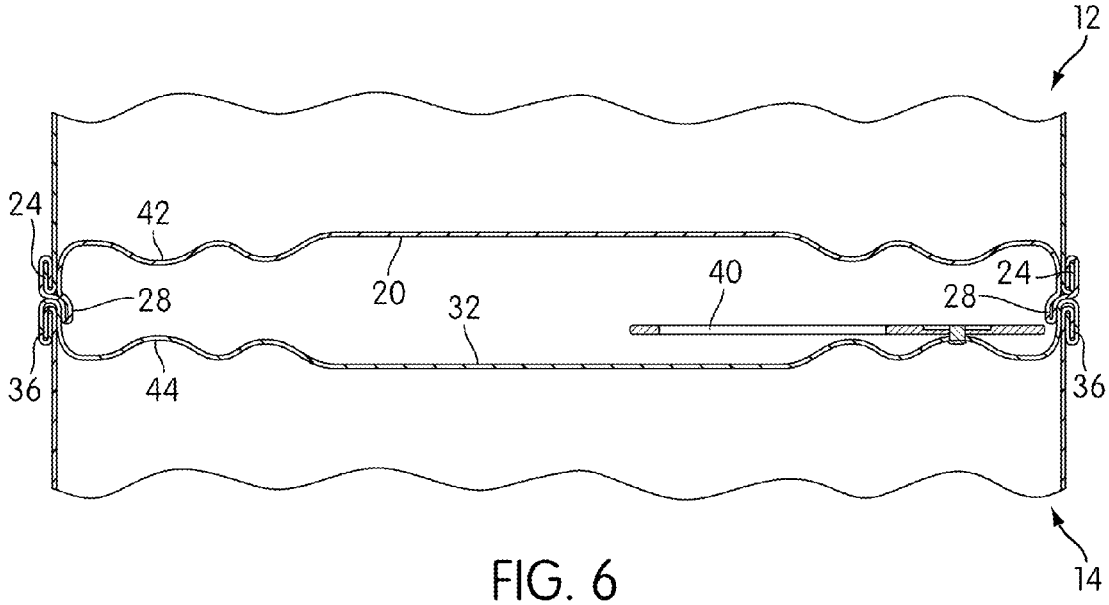
FIG. 6 shows a cross-sectional view of adjacent can portions of two stacked cans according to an exemplary embodiment.

FIG. 6 shows a cross-section of the lower portion of upper can 12 and the upper portion of lower can 14 after upper can 12 is placed on top of lower can 14 to create stack 10. In one embodiment, when upper can 12 is stacked on top of lower can 14, lower double seam 24 of upper can 12 is in contact with upper double seam 36 of lower can 14. As shown in the embodiment of FIG. 6, annular rim 28 is sized such that it does not come into contact with upper can end 32 of lower can 14. In this exemplary embodiment, the weight of upper can 12 (and the weight of any other cans stacked on top of upper can 12) is transferred to lower can 14 through the contact between the adjacent seams and not through a contact between annular rim 28 and upper can end 32.

Figure 7:
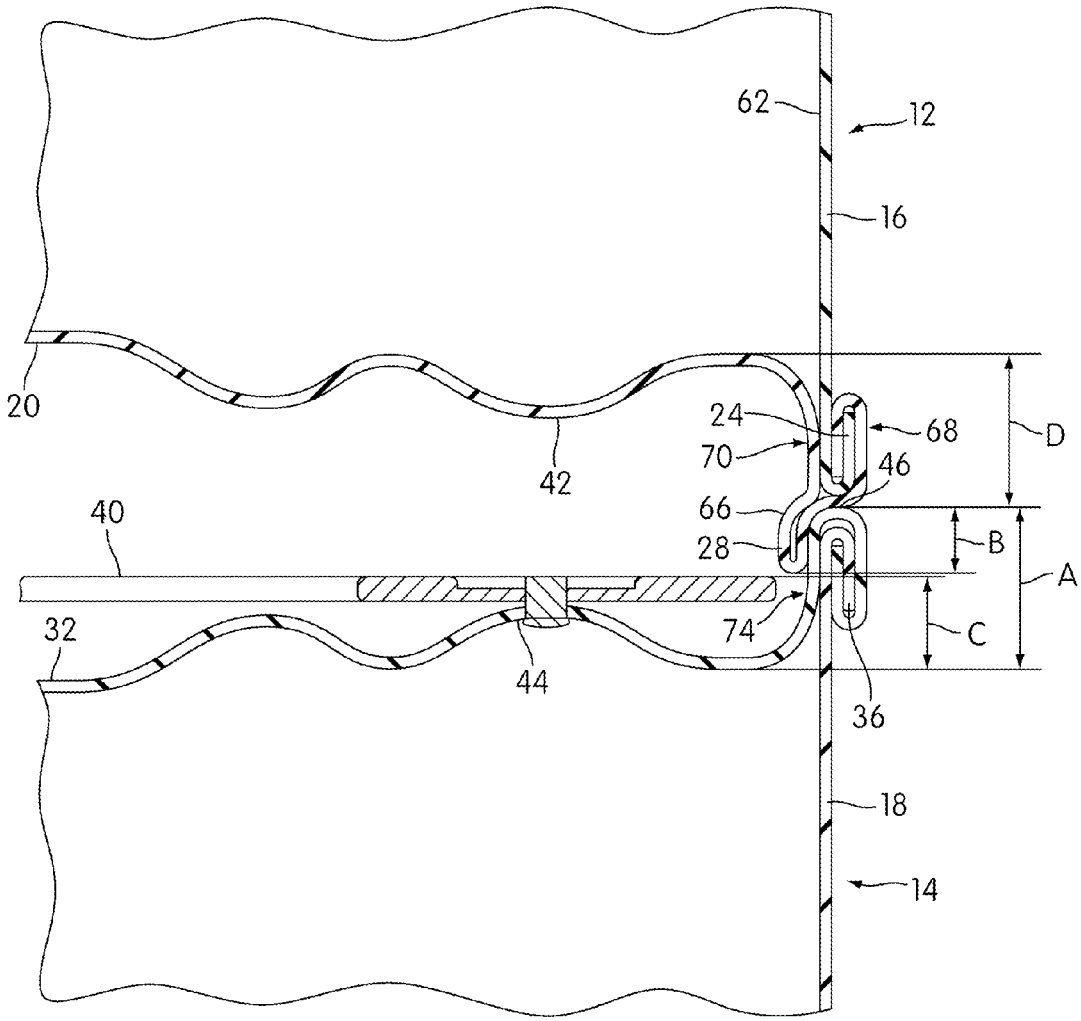
FIG. 7 shows a detailed cross-sectional view of a portion of FIG. 6.

FIG. 7 shows a detailed cross-section of the lower portion of upper can 12 and the upper portion of lower can 14 after upper can 12 is placed on top of lower can 14 to create stack 10. Lower can 14 includes upper double seam 36, upper can end 32, and pull-tab 40 coupled to upper can end 32. Upper can 12 includes lower can end 20, annular rim 28, and lower double seam 24.

As shown in FIG. 7, lower double seam 24 of upper can 12 includes an outer surface 68, an inner surface 70, and a shoulder, shown as substantially horizontal shoulder 46. Substantially horizontal shoulder 46 extends inwardly from outer surface 68. In the embodiment of FIG. 7, lower can end 20, inner surface 70 of lower double seam 24, annular rim 28, substantially horizontal shoulder 46, and outer surface 68 of lower double seam 24 are formed from a continuous piece of metal. As shown in FIG. 7, inner surface 70 of lower double seam 24 is a vertical surface positioned between lower can end 20 and annular rim 28. As shown in FIG. 7, the inner surface of annular rim 28 may include a rounded portion 66 between annular rim 28 and inner surface 70 of lower double seam 24. In another embodiment, an alignment feature, such as annular rim 28, may be positioned anywhere along inner surface 70 of lower double seam 24. In an alternative embodiment, an alignment feature, such as annular rim 28, may be positioned such that it extends from lower can end 20 as opposed to extending from either inner surface 70 of lower double seam 24 or substantially horizontal shoulder 46.

Substantially horizontal shoulder 46 has an inner portion (i.e., the portion of substantially horizontal shoulder 46 between its mid point and inner surface 70) and an outer portion (i.e., the portion of substantially horizontal shoulder 46 between its mid point and outer surface 68). Substantially horizontal shoulder 46 is perpendicular to the vertical axis of body sidewall 16 and is perpendicular to vertically positioned inner surface 70 and is parallel to the horizontal plane defined by lower can end 20 (i.e., the angle between the horizontal plane defined by lower can end 20 and the plane defined by substantially horizontal shoulder 46 is zero). In other embodiments, the shoulder may be angled either inwardly or outwardly such that the angle between the horizontal plane defined by lower can end 20 and the plane defined by substantially horizontal shoulder 46 is other than zero (e.g., angles between zero and five degrees, zero and twenty degrees, zero and forty five degrees, etc.).

Annular rim 28 acts to align upper can 12 relative to lower can 14 because as upper can 12 is brought into contact with lower can 14, annular rim 28 is received by lower can 14 such that annular rim 28 abuts an inner surface of upper double seam 36. In one embodiment, substantially horizontal shoulder 46 also defines a radially extending, downwardly facing surface that contacts upper double seam 36 of lower can 14 when the cans are stacked. In another embodiment, annular rim 28 is configured to align upper can 12 relative to lower can 14 such that the downwardly facing surface of substantially horizontal shoulder 46 contacts upper double seam 36 of lower can 14 when the cans are stacked. In another embodiment, annular rim 28 is configured to align upper can 12 relative to lower can 14 such that body sidewall 16 of upper can 12 is in axially alignment with body sidewall 18 of lower can 14 as shown in FIG. 7.

Annular rim 28 acts to resist and/or to prevent lateral relative movement between upper can 12 and lower can 14. As shown in FIG. 7, the alignment feature, shown as annular rim 28, extends from substantially horizontal shoulder 46 away from lower can end 20 of upper can 12. In the embodiment of FIG. 7, annular rim 28 extends from the inner portion of substantially horizontal shoulder 46 and specifically extends from the inner most edge of substantially horizontal shoulder 46. Similar to the embodiment of FIG. 13*a* discussed below, a double seam, such as double seam 24, may include an inner segment, a shoulder segment, and an outer segment, and an alignment feature, such as annular rim 28, may include an inner segment and an outer segment. The embodiment shown in FIG. 7 is similar to the embodiment shown in FIG. 13*a*. However, in the embodiment of FIG. 7, the inner segment of annular rim 28 is coupled to and positioned between the inner segment of double seam 24 and the outer segment of annular rim 28, and the outer segment of annular rim 28 is coupled to and positioned between the inner segment of annular rim 28 and the shoulder segment of double seam 24. This arrangement results in annular rim 28 being sized to be received within upper double seam 36 of lower can 14.

In this embodiment, the outer surface of annular rim 28 is adjacent the inner surface of upper double seam 36 of lower can 14. When a lateral force acts on either upper can 12 or lower can 14, the outer surface of annular rim 28 and the inner surface of upper double seam 36 will be brought into contact with each other, and this contact will resist and/or prevent lateral relative movement between upper can 12 and lower can 14. The resistance or prevention of relative lateral movement between upper can 12 and lower can 14 operates to prevent cans in stack 10 from shifting or tipping over.

In another embodiment, annular rim 28 has an outer surface that is in contact with the inner surface of upper double seam 36 in the absence of a lateral force acting on either upper can 12 or lower can 14. In addition, in this embodiment it should be noted that the radius of upper can 12 at lower double seam 24 (i.e., the distance from the center of lower can end 20 to the outer surface of lower double seam 24) is substantially the same as or equal to the radius of upper can end 32 at upper double seam 36 (i.e., the distance from the center of upper can end 32 to the outer surface of upper double seam 36). Because the radiuses are equal, a can having an upper portion configured as the upper portion of lower can 14 and a lower portion configured as the lower portion of upper can 12 will tend to roll in a straight line during various processes (e.g., manufacturing, filling, cooking, transporting, etc.). In another embodiment, annular rim 28 is sized to provide an interference fit within upper double seam 36.

In another embodiment, as discussed below regarding FIGS. 11-13*b*, annular rim 28 may extend from an outer half of substantially horizontal shoulder 46. In this embodiment, an inner surface of annular rim 28 is adjacent the outer surface of upper double seam 36 of lower can 14, and when a lateral force acts on either upper can 12 or lower can 14, the outer surface of upper double seam 36 and the inner surface of annular rim 28 will be brought into contact with each other and this contact will resist or prevent lateral relative movement between upper can 12 and lower can 14.

Referring to FIG. 7, upper can end 32 is countersunk relative to the upper surface of upper double seam 36 defining an end wall countersink distance, shown as upper can end countersink distance A. Further, annular rim 28 has an alignment feature length, shown as annular rim length B. Annular rim length B is the distance between the downwardly facing surface of substantially horizontal shoulder 46 and the distal most point of annular rim 28. In one embodiment, annular rim length B is the distance that annular rim 28 extends beyond lower double seam 24 of upper can 12. Pull-tab 40 includes a tab height, shown as pull-tab height C. In one embodiment, pull-tab height C is the distance between an upper most surface of pull-tab 40 and a substantially horizontal plane defined by upper can end 32. In the embodiment of FIG. 7, lower can end 20 is countersunk relative to lower double seam 24 defining an end wall countersink distance, shown as lower can end countersink distance D. In one embodiment, the lower portion of each can in stack 10 is configured as discussed above regarding the lower portion of upper can 12 and the upper portion of each can in stack 10 is configured as discuss above regarding the upper portion of lower can 14.

Referring to FIG. 7, in one embodiment annular rim length B is less than upper can end countersink distance A such that when upper can 12 is stacked on top of lower can 14, annular rim 28 does not come into contact with the substantially horizontal portions of upper can end 32. In this embodiment, the weight of upper can 12 is transferred to lower can 14 through the contact between lower double seam 24 and upper double seam 36 and not through annular rim 28. In addition, because the contact between lower double seam 24 and upper double seam 36 is positioned above and in axial alignment with body sidewall 18, the weight of upper can 12 is born through sidewall 18. This arrangement may allow lower can 14 to support more weight (e.g., more cans may be placed in stack 10) than if the weight were supported by upper can end 32. In one embodiment, annular rim 28 and pull-tab 40 are positioned such that annular rim 28 does not come into contact with pull-tab 40. This prevents an unintended breach in or removal of upper can end 32 that may be otherwise caused by contact between annular rim 28 and pull-tab 40 after creation of stack 10.

In the embodiment of FIG. 7, the distance between upper can end 32 and lower can end 20, shown as the combination (e.g., sum) of upper can end countersink distance A and lower can end countersink distance D, is greater than pull-tab height C. This configuration works to prevent an unintended breach in or removal of upper can end 32 that may be otherwise caused by contact between lower can end 20 and pull-tab 40 after creation of stack 10.

During certain heating processes, containers, such as upper can 12 and lower can 14, may be positioned horizontally and pushed end to end through a heating apparatus. While being pushed end to end, the interaction between the can ends of upper can 12 and lower can 14 may be the same as when the cans are stacked as shown in FIG. 7. Further, during certain heating processes, such as cooking or sterilization, the can ends of upper can 12 and lower can 14 may expand outward as a result of increased pressure within the cans. This expansion is facilitated by concentric beads 42 and 44 and acts to prevent rupture of the can. As can be seen in FIG. 7, if upper can end 32 and lower can end 20 expands outwardly, upper can end countersink distance A and lower can end countersink distance D will both decrease and pull-tab height C will increase. In one embodiment, upper can 12 and lower can 14 are constructed such that the sum of upper can end countersink distance A and lower can end countersink distance D is greater than pull-tab height C when the cans are subjected to heating. This configuration works to prevent an unintended breach in or removal of upper can end 32 that may be otherwise caused by contact between lower can end 20 and pull-tab 40 during a heating process. In another embodiment, upper can 12 and lower can 14 are constructed such that the sum of upper can end countersink distance A and lower can end countersink distance D is sufficient that lower can end 20 does not contact upper can end 32 when the cans are subjected to heating. It should be understood that following such a heating procedure, the contents of the can will cool, returning the cans to the unexpanded state as shown in FIG. 7.

According to an exemplary embodiment, upper can 12 and/or lower can 14 may include a liner (e.g., an insert, coating, lining, etc.), shown as protective coating 62. Protective coating 62 is positioned within the interior chamber of upper can 12 and is attached to the inner surface of body sidewall 16. Protective coating 62 acts to protect the material of the container from degradation that may be caused by the contents of the container. In an exemplary embodiment, protective coating 62 may be a coating that may be applied via spraying or any other suitable method. As shown in FIG. 7, the material that forms inner surface 70 abuts the inner surface of sidewall 16 close to the point where inner surface 70 transitions to lower can end 20. This allows for protective coating 62 to fully coat the interior of upper can 12. A gap between the material that forms inner surface 70 and the inner surface of sidewall 16 that extends into annular rim 28 may make complete coverage of the interior of upper can 12 with protective coating 62 difficult because it may be difficult to force protective coating 62 into narrow spaces.

According to an exemplary embodiment, the interior surface of the container material is pre-coated with protective coating 62 before the container is formed. According to various other exemplary embodiments, the interior and/or exterior of the container are coated with protective coating 62 after the container is formed or substantially formed. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, and/or other suitable preservative spray. The interior surfaces of the container ends may also be coated with a protective coating as described above.

Figure 8A:
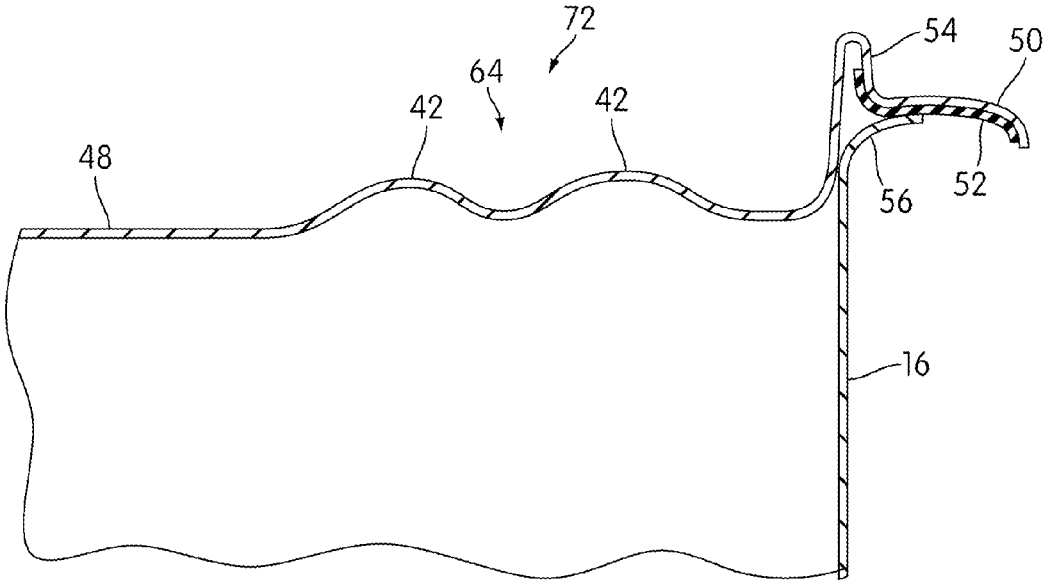
FIG. 8*a* shows a cross-sectional view of a can end component positioned adjacent to a can body prior to the formation of a double seam, according to an exemplary embodiment.
Figure 8B:
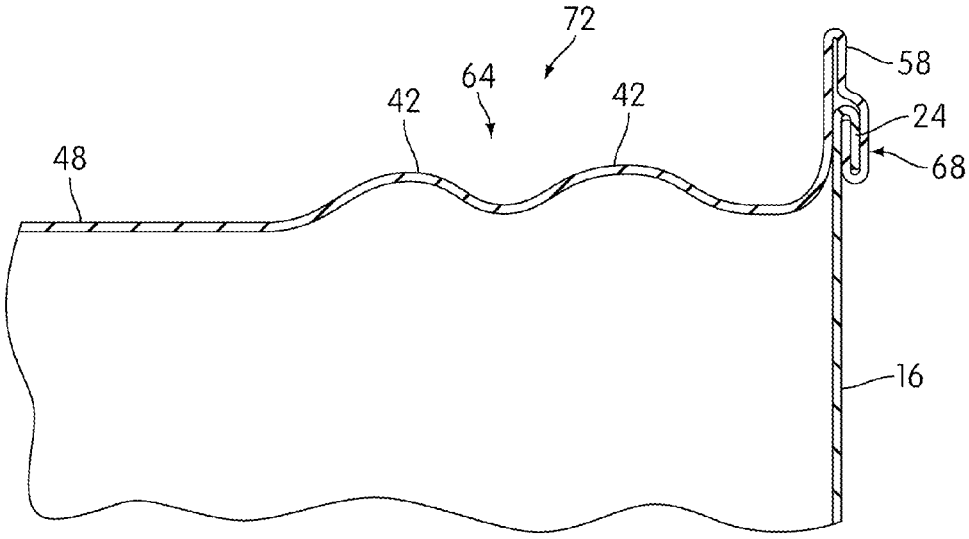
FIG. 8*b* shows a cross-sectional view of the can end component and can body of FIG. 8*a* following the formation of a double seam according to an exemplary embodiment.
Figure 8C:
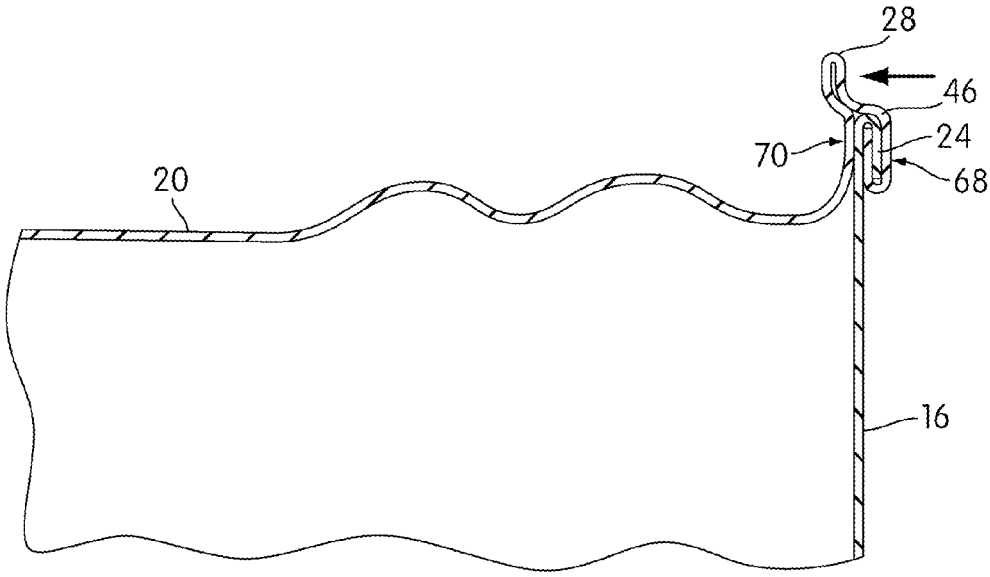
FIG. 8*c* shows a cross-sectional view of the can end component and can body of FIG. 8*b* following the formation of an alignment feature according to an exemplary embodiment.

FIGS. 8*a*-8*c* depict the coupling of a can end component to a can body and formation of an alignment feature, according to an exemplary embodiment. Referring to FIG. 8*a*, can end component 72 is shown positioned adjacent the lower end of body sidewall 16 prior to the formation of lower double seam 24. Can end component 72 includes an end wall portion 64. End wall portion 64 includes concentric beads 42, and a center portion, shown as center panel 48. End wall portion 64 is the portion of can end component 72 that forms lower can end 20 after the can end is coupled to the body side wall via a seam such as a double seam. Can end component 72 also includes a seaming portion, shown as seaming panel 50, and a feature, shown as annular bead 54. In one embodiment, seaming panel 50 includes a sealing compound 52. In one embodiment, sealing compound 52 may extend into the annular bead 54. In this embodiment, the sealing compound 52 may give the stacking feature more width or thickness than if the seaming compound 52 did not extend into the annular bead 54

Body sidewall 16 includes a flange, shown as seaming flange 56. Seaming flange 56 extends outwardly from body sidewall 16. As shown, in FIG. 8*a*, prior to the formation of lower double seam 24, can end component 72 is positioned adjacent body sidewall 16 such that seaming flange 56 is adjacent seaming panel 50 and annular bead 54 is positioned in axial alignment with body sidewall 16.

Referring to FIG. 8*b*, can end component 72 is shown following the formation of lower double seam 24. Lower double seam 24 is formed by folding seaming panel 50 and seaming flange 56 together and then pressing (e.g., ironing, compressing, flattening, and/or using force to compress) the folded seaming panel 50 and seaming flange 56. After pressing, lower double seam 24 forms a hermetic seal such that air is not able to pass through lower double seam 24. In one embodiment, sealing compound 52 aids in the formation of the hermetic seal by filling in any gaps that might otherwise exist in lower double seam 24 between the folded material of seaming panel 50 and seaming flange 56. Sealing compound 52 is a rubberized material that is compressed and caused (e.g., forced, squeezed, etc.) to flow into any such gaps when the folded together seaming panel 50 and seaming flange 56 are pressed to form lower double seam 24.

In an exemplary embodiment, lower double seam 24 may be formed using a can seaming machine (e.g., a seamer, double seamer, closing machine, etc.). A seaming machine, may include a base plate and a chuck. Can end component 72 and body sidewall 16 may be held in place adjacent to each other by a load applied vertically through the base plate. The formation of the double seam may take place in two steps as discussed above. Lower double seam 24 may be formed using a seaming machine that holds body sidewall 16 and can end component 72 stationary on the chuck while seaming rolls revolve around body sidewall 16 and can end component 72 to form double seam 24. In a second style of seaming machine, body sidewall 16 and can end component 72 are held between a rotating chuck and base plate, which rotates body sidewall 16 and can end component 72 to form double seam 24.

As can be seen from FIG. 8*b*, annular bead 54 is pressed or compressed to form an annular rim 58 that extends from lower double seam 24. Following compression of annular bead 54, annular rim 58 is in axial alignment with body sidewall 16. Compression of annular bead 54 to form annular rim 58 may occur when seaming panel 50 is folded with seaming flange 56, when the folded together seaming panel 50 and seaming flange 56 are pressed to form lower double seam 24 or in a separate step that acts to form annular rim 58.

Referring to FIG. 8*c*, creation of an alignment feature, shown as annular rim 28, is shown according to an exemplary embodiment. As shown in FIG. 8*c*, a force is applied to annular rim 58 to bring annular rim 58 out of alignment with body sidewall 16 to create annular rim 28. As shown in FIG. 8*c*, the force is an inwardly directed force that causes annular rim 28 to extend from the inner portion of substantially horizontal shoulder 46 of lower double seam 24. In another embodiment, an outwardly directed force is applied to annular rim 58 to create an alignment feature the extends from an outer portion of substantially horizontal shoulder 46 of lower double seam 24. In another embodiment, the force shown in FIG. 8*c* is applied to annular bead 54 prior to creation of lower double seam 24 and/or prior to creation of annular rim 58.

Figure 9:
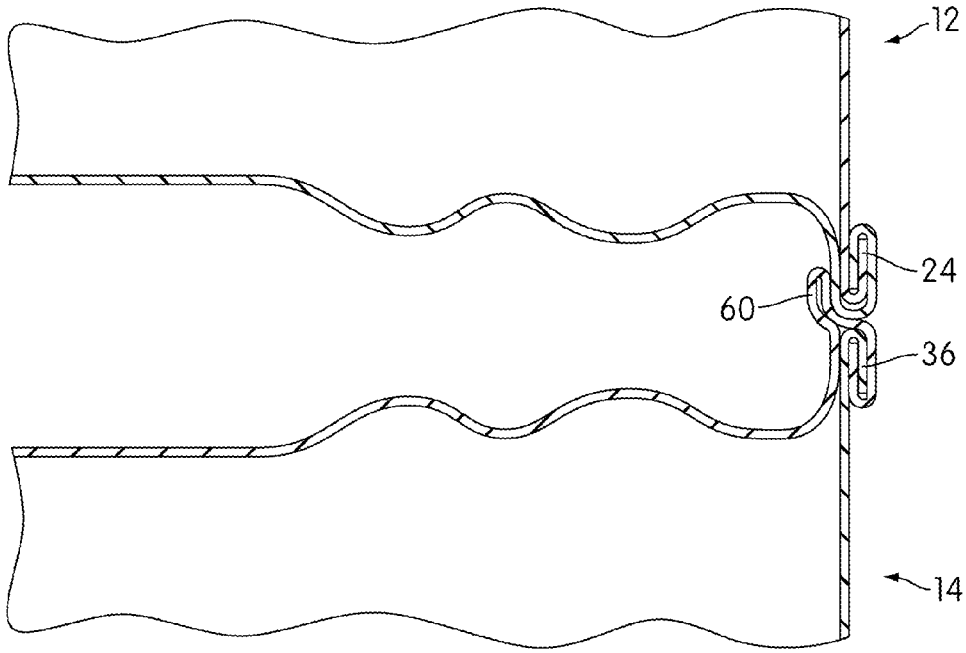
FIG. 9 shows a cross-sectional view of a portion of a can having an alignment feature received by a second can according to an exemplary embodiment.

FIG. 9 shows two stacked cans according to an exemplary embodiment. In FIG. 9, an alignment feature, shown as annular rim 60, extends from upper double seam 36 of lower can 14. Upper can 12 is placed on top of lower can 14, and annular rim 60 is received within lower double seam 24 of upper can 12.

Figure 10A:
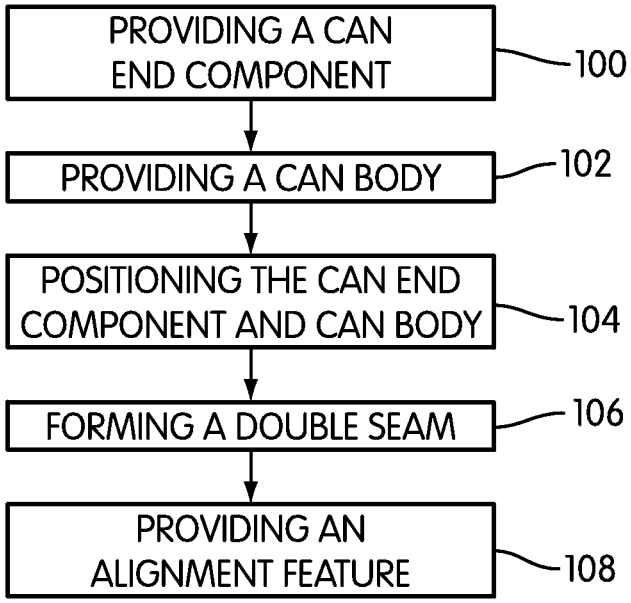
FIG. 10*a* shows a flow diagram of the creation of a can having an alignment feature according to an exemplary embodiment.

FIG. 10 is a flow chart of the creation of a container having an alignment feature according to an exemplary embodiment. At step 100 a can end component is provided. The can end component includes a center portion and a seaming portion. At step 102 a can body is provided. The can body includes a first end, a sidewall, and a flange. At step 104 the can end component is positioned adjacent the can body such that the flange of the can body is adjacent the seaming portion of the can end component. At step 106 a double seam is formed by folding the seaming portion and the flange together. The double seam formed during step 106 includes a shoulder. At step 108 an alignment feature is provided that extends from the shoulder of the double seam away from the now formed can end.

Figure 10B:
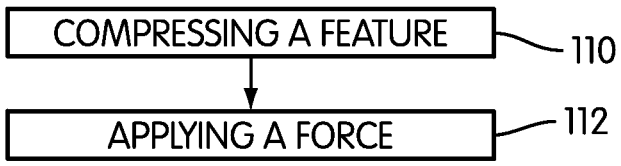
FIG. 10*b* shows a detailed flow diagram of step 108 shown in FIG. 10*a* according to an exemplary embodiment.
Figure 11:
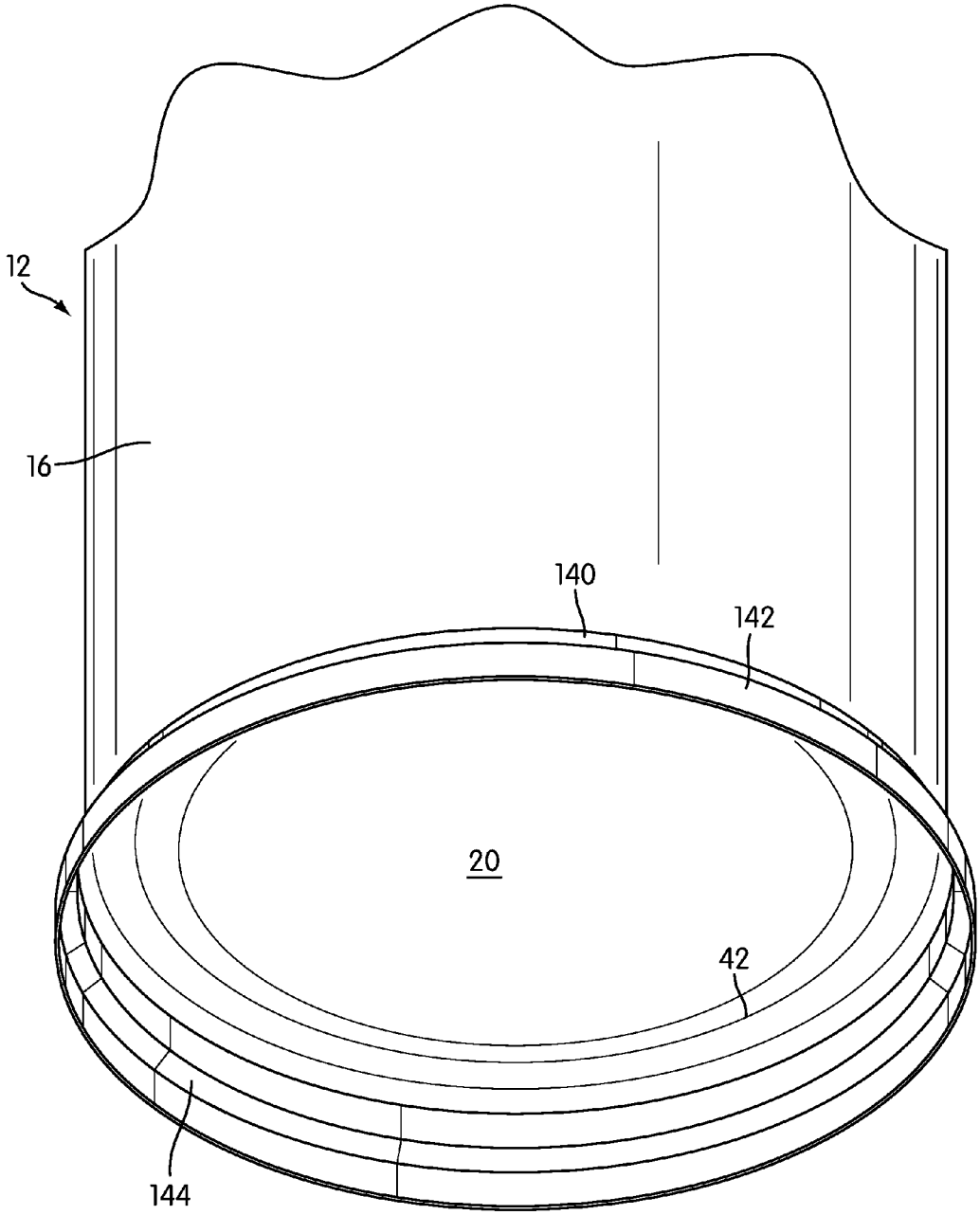
FIG. 11 shows a perspective view of a portion of a can including an alignment feature according to an exemplary embodiment.

FIG. 10*b* is a detailed flow chart of step 108, according to an exemplary embodiment. At step 110, a feature, positioned between the center portion and seaming portion of the can end component, is compressed to create an annular rim extending from the double seam and positioned in axial alignment with the sidewall of the can body. At step 112 a force is applied to the annular rim created during step 110 to bring the annular rim out of axial alignment with the sidewall of the can body. In an exemplary embodiment of step 112, the force is an inwardly directed force which displaces the annular rim inwardly resulting in an alignment feature extending from an inner half of the double seam.

FIGS. 11-13*b* depict upper can 12 including an alignment feature and lower seam or bead according to another exemplary embodiment. In the embodiment shown in FIGS. 11-13*b*, upper can 12 includes a body sidewall 16, a lower bead or seam, shown as lower double seam 140, an alignment feature, shown as annular rim 142, and a lower can end 20. Lower double seam 140 includes a substantially horizontal shoulder 144. Generally, annular rim 142 extends from an outer half of substantially horizontal shoulder 144 such that, when upper can 12 is stacked on top of lower can 14, upper double seam 36 of lower can 14 is received within annular rim 142. In this embodiment, an inner surface of annular rim 142 is adjacent the outer surface of upper double seam 36 of lower can 14, and when a lateral force acts on either upper can 12 or lower can 14, the outer surface of upper double seam 36 and the inner surface of annular rim 142 will be brought into contact with each other and this contact will resist or prevent lateral relative movement between upper can 12 and lower can 14. In addition, the contact between an inner surface of annular rim 142 and the adjacent the outer surface of upper double seam 36 of lower can 14 may also resist longitudinal movement via friction between the surfaces. It should be understood that, while FIGS. 11-13*b* depict annular rim 142 extending from lower double seam 140 located at the bottom of upper can 12, in another embodiment, annular rim 142 may extend from a double seam located at the top of can 12 and/or may extend from either the upper and/or lower seam of lower can 14.

Figure 12A:
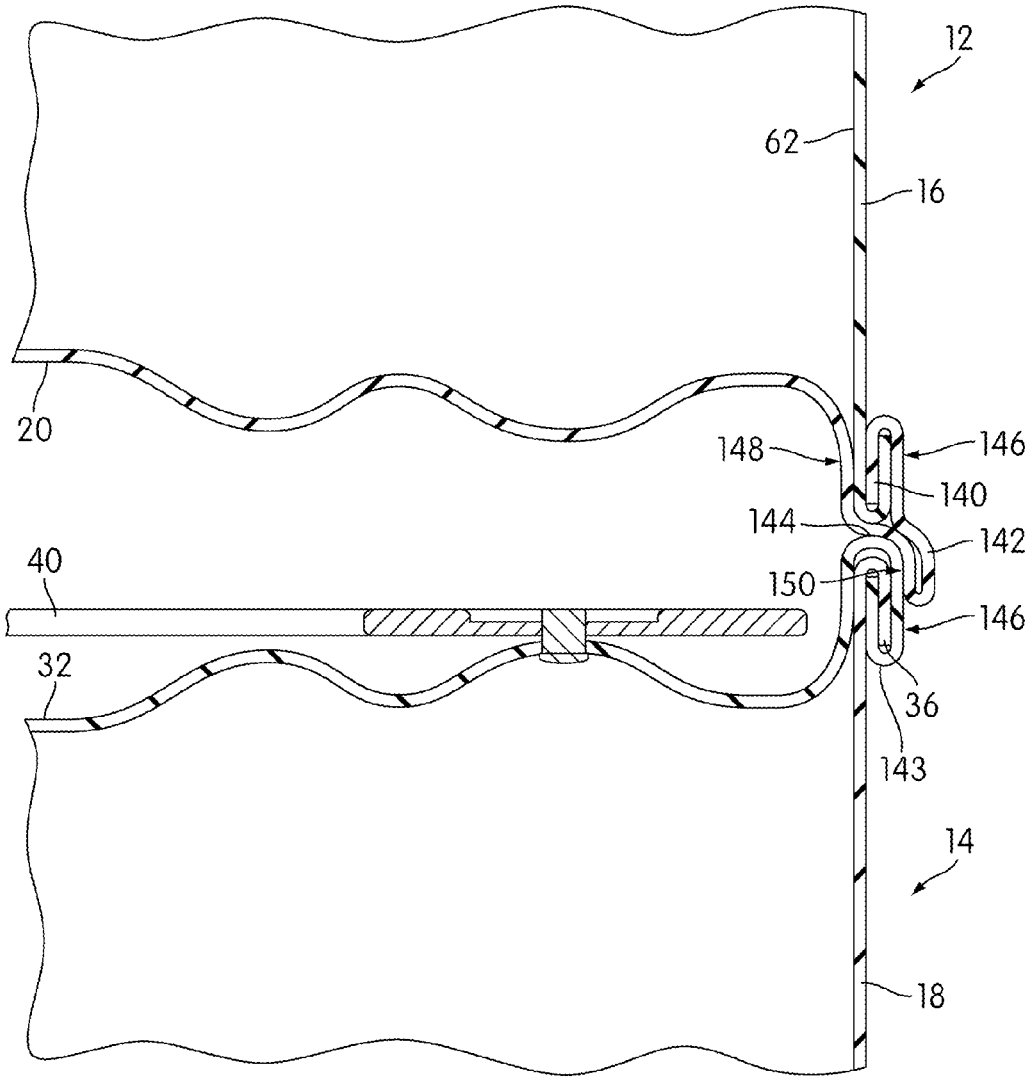
FIG. 12A shows a detailed cross-sectional view of adjacent can portions of two stacked cans according to an exemplary embodiment.

FIG. 12A shows a cross-section of the lower portion of upper can 12 and the upper portion of lower can 14 after upper can 12 is placed on top of lower can 14 to create stack 10. As discussed above, when upper can 12 is stacked on top of lower can 14, the horizontal shoulder 144 of lower double seam 140 is in contact with upper double seam 36 of lower can 14 such that the weight of upper can 12 (and the weight of any other cans stacked on top of upper can 12) is transferred to or born by lower can 14 through the contact between the adjacent seams and not through contact between upper can 12 and upper can end 32 of lower can 14. In this embodiment, annular rim 142 is configured to align upper can 12 relative to lower can 14 such that body sidewall 16 of upper can 12 is in axially alignment with body sidewall 18 of lower can 14 as shown in FIG. 12A. Annular rim 142 acts to align upper can 12 relative to lower can 14 because as upper can 12 is brought into contact with lower can 14, upper double seam 36 is received within annular rim 142 such that annular rim 142 abuts an outer surface of upper double seam 36. When a lateral force acts upon either upper can 12 or lower can 14, an inner surface 150 of annular rim 142 engages with (e.g., contacts, etc.) the outer surface 152 of upper double seam 36 to resist and/or prevent lateral movement of upper can 12 relative to lower can 14.

As can be seen in the embodiment of FIG. 12A, the outside diameter of double seam 140 at outer surface 146 is substantially the same as the outside diameter of lower can 14 at upper double seam 36. This relative sizing allows for the axial alignment of upper can 12 and lower can 14 when the cans are stacked. The relative sizing also allows the horizontal shoulder 144 of lower double seam 140 to contact upper double seam 36 of lower can 14 when the cans are stacked. In one embodiment, the outside diameter of the upper double seam 36 of lower can 14 is three inches, and the diameter of upper can 12 measured to the inner surface 150 of annular rim 142 is slightly more than three inches to allow annular rim 142 to receive upper double seam 36 when upper can 12 and lower can 14 are stacked. In other embodiments, the outside diameter of the upper double seam 36 of lower can 14 may be any size typically used for a food can (e.g., $2^{11}/_{16}{}^{th}$ inches, $3^{3}/_{16}{}^{th}$ inches, $4^{4}/_{16}{}^{th}$ inches, etc.). In one embodiment, the distance from the center of lower can end 20 to inner surface 150 of annular rim 142 is slightly less than the distance from the center of upper can end 32 to outer surface 152 of upper bead 36 resulting in an interference fit between upper can 12 and lower can 14.

As shown in FIG. 12A, lower double seam 140 of upper can 12 includes an outer surface 146, an inner surface 148, and a substantially horizontal shoulder 144 that generally extends in the radial direction from inner surface 148 to the innermost edge or portion of annular rim 142. As shown, annular rim 142 extends from the lower and outermost corner of lower double seam 140 located between substantially horizontal shoulder 144 and outer surface 146. In another embodiment, an alignment feature, such as annular rim 142, may be positioned to extend from anywhere along outer surface 146 of lower double seam 140. In the embodiment shown, lower can end 20, inner surface 148, annular rim 142, substantially horizontal shoulder 144, and outer surface 146 of lower double seam 140 are formed from a continuous piece of metal.

Figure 12B:
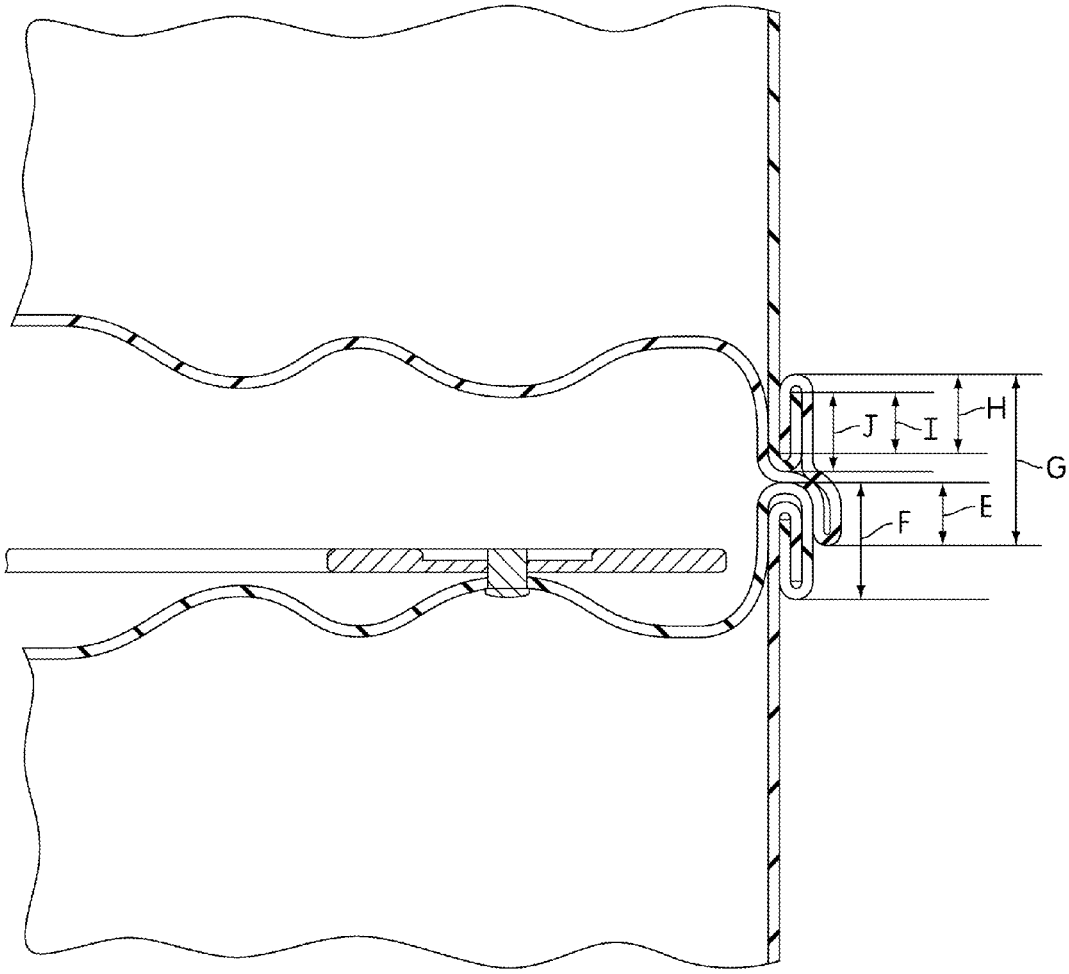
FIG. 12B shows a detailed cross-sectional view of FIG. 12A marked to depict the sizes of various portions of the adjacent cans.

Referring to FIG. 12B, in the embodiment shown, annular rim 142 is sized such that it does not extend beyond lower edge 143 of upper bead 36. In other words, in this embodiment, the length of annular rim 142, depicted by the letter E, is less than the length of upper bead 36, depicted by the letter F. In other embodiments, the length E of annular rim 142 is greater than length F of upper bead 36 such that annular rim 142 extends beyond lower edge 143 of upper bead 36. In one embodiment, the length of annular rim 142, depicted by the letter E, is between about 0.015 inches and 0.030 inches.

In various embodiments, the lengths indicated by letters E-J, in FIG. 12B, may be selected as is appropriate for the size of a particular upper can 12. In one embodiment, the height from the upper edge of double seam 140 to the lower edge of annular rim 142, depicted by the letter G, is 0.119 inches. In one embodiment, the overhook length, depicted by the letter H, is 0.071 inches. In one embodiment, the overlap length, depicted by the letter I, is 0.052 inches. In one embodiment, the bodyhook length, depicted by the letter J, is 0.079 inches.

Figure 13A:
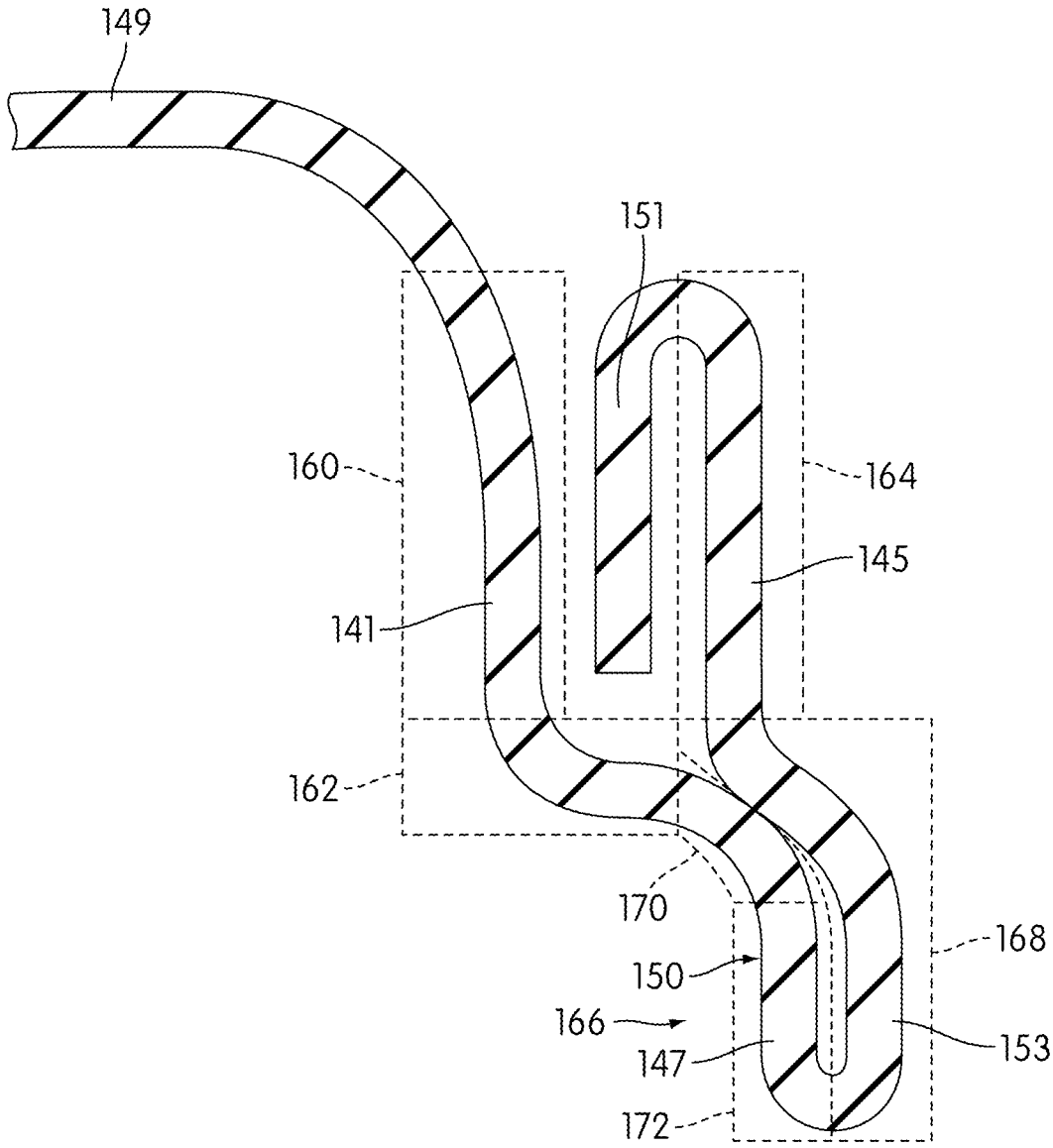
FIG. 13*a* shows a detailed cross-sectional view of a portion of a can including an alignment feature according to an exemplary embodiment.

FIG. 13*a* shows a detailed view of double seam 140 and annular rim 142 with sidewall 16 removed for ease of depiction (in FIG. 13*a*, each segment of seam 140 and annular rim 142 is shown within a box drawn with dashed lines labeled with the appropriate reference numeral for ease of reference). In the embodiment shown, lower can end 20, double seam 140 and annular rim 142 are formed from a continuous piece of metal. As shown, double seam 140 includes an inner segment 160, a shoulder segment 162, and an outer segment 164, and annular rim 142 includes an inner segment 166 and an outer segment 168. Inner segment 160 is coupled to and positioned between lower can end 20 and shoulder segment 162 and extends in the longitudinal direction (i.e., oriented at a nonzero angle relative to a horizontal plane defined by lower can end 20) away from can end 20. In the embodiment shown, inner segment 160 is a substantially vertically oriented segment (i.e., generally parallel to the longitudinal axis of upper can 12). In various embodiments, inner segment 160 may be positioned at various angles relative to the longitudinal axis of upper can 12 (e.g., within 5 degrees of the longitudinal axis of upper can 12, within 10 degrees of the longitudinal axis of upper can 12, within 20 degrees of the longitudinal axis of upper can 12, within 30 degrees of the longitudinal axis of upper can 12, within 45 degrees of the longitudinal axis of upper can 12, etc.). As shown, inner segment 160 includes inner surface 148.

Shoulder segment 162 is coupled to and positioned between inner segment 160 of double seam 140 and inner segment 166 of annular rim 142. Shoulder segment 162 extends in the radial direction (i.e., oriented at a nonzero angle relative to the longitudinal axis of upper can 12). In the embodiment shown, shoulder segment is substantially horizontally oriented (i.e., generally parallel to the radial axis of upper can 12). In various embodiments, shoulder segment 162 may be positioned at various angles relative to the radial axis of upper can 12 (e.g., within 5 degrees of the radial axis of upper can 12, within 10 degrees of the radial axis of upper can 12, within 20 degrees of the radial axis of upper can 12, within 30 degrees of the radial axis of upper can 12, within 45 degrees of the radial axis of upper can 12, etc.).

Shoulder segment 162 includes substantially horizontal shoulder 144 that is in contact with the upper surface of upper double seam 36 when upper can 12 is stacked on top of lower can 14. In this embodiment, the orientation of shoulder segment 162 relative to the radial axis of upper can 12 allows substantially horizontal shoulder 144 to contact substantially the entire length the upper surface of upper seam 36 in the radial direction. In one embodiment, the substantially complete contact between substantially horizontal shoulder 144 and the upper surface of upper seam 36 aids in the support of the upper cans in the stack through the contact between the seams of adjacent cans. In another embodiment, the substantially complete contact between substantially horizontal shoulder 144 and the upper surface of upper seam 36 aids in the resistance of lateral movement due to frictional forces between substantially horizontal shoulder 144 and the upper surface of upper seam 36. In some embodiments, shoulder segment 162 may be oriented at an angle to match the angle of the upper surface of upper double seam 36.

Inner segment 166 of annular rim 142 is coupled to and positioned between shoulder segment 162 and outer segment 168 of annular rim 142, and outer segment 168 of annular rim 142 is coupled to and positioned between inner segment 166 of annular rim 142 and outer segment 164 of double seam 140. Inner segment 166 includes a first portion, shown as angled portion 170 and a second portion, shown as contact portion 172. Angled portion 170 is coupled to and positioned between shoulder segment 162 and contact portion 172. Angled portion 170 extends both in the radial direction and in the longitudinal direction (i.e., is at a nonzero angle relative to both the longitudinal axis and radial axis of upper can 12) away from lower can end 20 such that annular rim 142 is able to contact the outer surface of upper double seam 36.

Figure 13B:
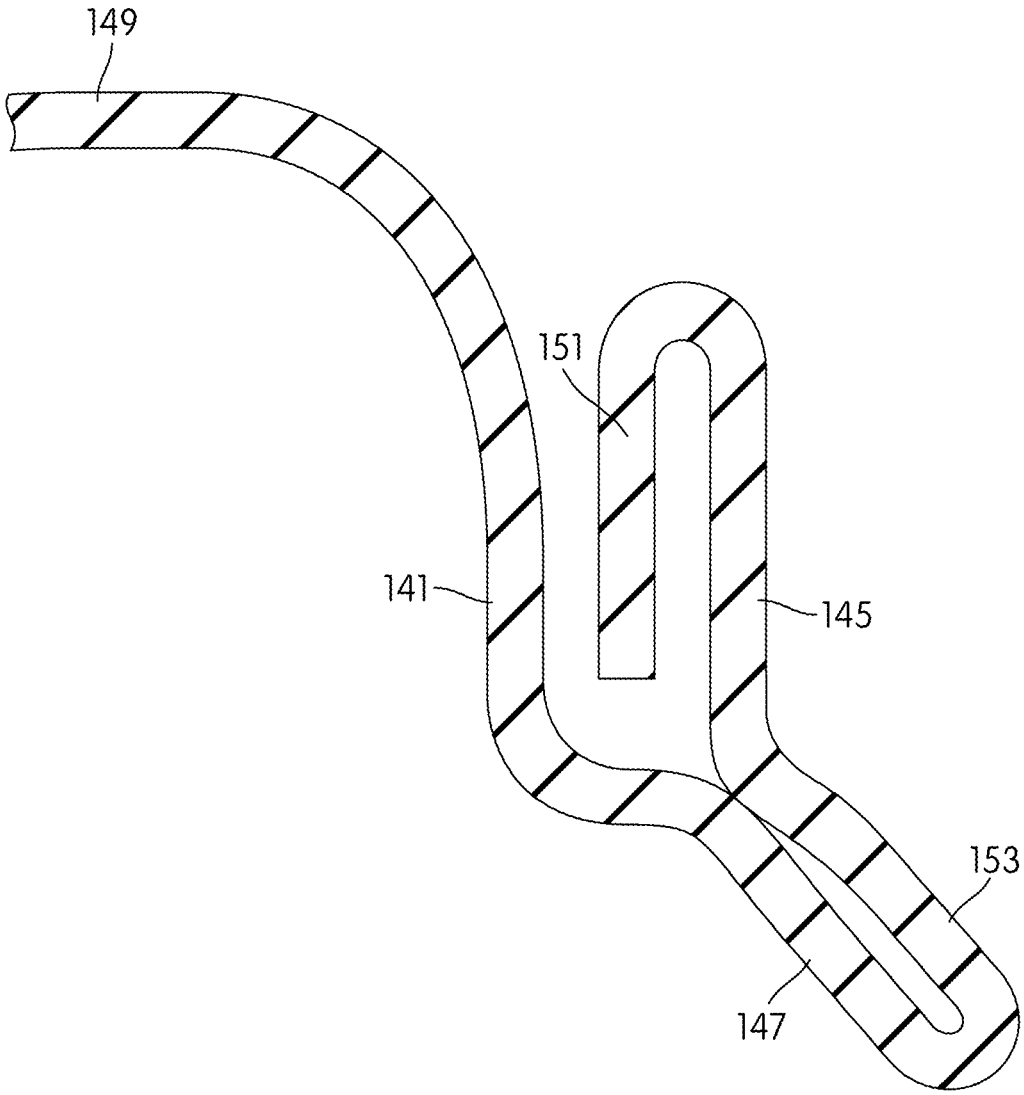
FIG. 13*b* shows a detailed cross-sectional view of a portion of a can including an alignment feature according to an exemplary embodiment.

In one embodiment, the extension of angled portion 170 in the radial direction is sufficient such that the distance from the center of lower can end 20 to inner surface 150 of annular rim 142 is slightly greater than the distance from the center of upper can end 32 to outer surface 152 of upper double seam 36. This allows upper double seam 36 to be received within annular rim 142 when upper can 12 is stacked on top of lower can 14. Generally, the geometry (e.g., shape, angles, etc.) of angled portion 170 substantially matches or mirrors the geometry of the portion of upper double seam 36 that is in contact with angled portion 170. This arrangement provides for substantially constant or complete contact between angled portion 170 and upper double seam 36. In one embodiment, angled portion 170 is a continuously curved section, and in another embodiment (as shown in FIG. 13*b*), angled portion 170 is a substantially linear section.

Contact portion 172 is coupled to and positioned between angled portion 170 and outer segment 168. Together, the inner surfaces of both angled portion 170 and contact portion 172 make up inner surface 150 that contacts outer surface 152 of upper double seam 36 to resist lateral movement as discussed above. In the embodiment shown in FIG. 13*a*, contact portion 172 is a substantially vertically oriented portion (i.e., oriented substantially parallel to the longitudinal axis of upper can 12) and extends away from lower can end 20. In the embodiment shown in FIG. 13*b*, contact portion 172 extends in both the longitudinal and radial directions.

The angular position of contact portion 172 relative to the longitudinal axis of upper can 12 is selected such that sufficient contact to resist lateral movement is provided (e.g., plus or minus 1 degree, plus or minus 1 to 5 degrees, plus or minus 1 to 10 degrees, plus or minus 1 to 20 degrees, etc.). In other embodiments, the angular position of contact portion 172 relative to the longitudinal axis of upper can 12 is selected to match the angular position, shape, geometry, etc. of outer surface 152 of upper seam 36 to ensure sufficient contact to resist lateral movement.

Outer segment 168 of annular rim 142 is coupled to and positioned between contact portion 172 and outer segment 164 of double seam 140. In the embodiment shown, outer segment 168 substantially mirrors the shape of angled portion 170 and contact portion 172. Outer segment 164 of double seam 140 includes outer surface 146 and is coupled to the lower segment of body sidewall 16 to create the double seam as discussed above.

Referring to FIGS. 11-13*b*, can end 20 can also be described in an alternative fashion in reference to an end wall and concentric bands. In particular, annular rim 142 can also be described as formed from a pair of bands (labeled as rings 147 and 153), and the portions labeled as 141, 151, and 145 of can end 20 can be described as bands (shown as rings 141, 151, and 145). As shown, ring 141 is joined at about a right angle to end wall 149, and rings 151 and 145 are generally concentric with ring 141. Ring 147 is joined to ring 141 at about a 90 degree angle (relative to the horizontal plane defined by end wall 149) or at any other angle (e.g., 90 to 175 degrees, preferably 90 to 135 degrees, see FIGS. 13*a* and 13*b*) suitable so that the radius of surface 150, measured in at least one location, is greater than the outside diameter of ring 145. As described above, this facilitates stacking and prevents lateral movement of stacked cans. Ring 153 joins rings 147 and 145 and is concentric with ring 147, and ring 151 is joined to ring 145. As can be seen in FIG. 12*a*, the lower end of sidewall 16 includes a first portion that is located between rings 141 and 151 and also includes a second portion that is located between rings 151 and 145. In an exemplary embodiment for a particular circular can size having a diameter of three inches measured at the outside of ring 145, the diameter of rings 141, 151, 145, 147 and 153 are all in the range of about 2.95 inches to 3.05 inches. For typical cans, the end wall and bands are circular with a particular diameter (i.e., 2× radius). However, the end wall and bands could also be generally square, rectangular, four-sided or multisided with rounded corners having a radius of rounding to join the sides (e.g., a sardine can, ham can, etc.). As can be seen the thickness of double seam 140 (i.e., the distance from inner surface 148 to outer surface 146) is generally two times the thickness of sidewall 16 plus three times the thickness of the material of can end 20 plus any thickness that results from seaming compound (e.g., seaming compound 52 discussed above). In addition, the thickness of annular rim 142 is generally two time the thickness of the material of can end 20 plus any thickness that results from seaming compound. In one embodiment, the thickness of body sidewall 16 is about 0.0085 inches, the thickness of the material of can end 20 is about 0.0080 inches, and the thickness that results from the seaming compound is about 0.005 inches. Thus, in this embodiment the thickness of double seam 140 is about 0.046 inches. In another embodiment, the maximum thickness of double seam 140 is about 0.046. Further, in this embodiment the thickness of annular rim 142 is about 0.016 inches thick. In this exemplary embodiment, the diameter of rings 141, 151, 145, 147 and 153 are all in the range of about 2.977 inches to 3.023 inches.

Referring again to FIGS. 6, 7, 8*b*, 9, 12*a*, and 12*b*, after can end 20 is fastened to side wall 16, the outside radius of ring 141 will be generally the same as the inside radius of side wall 16. The inside radius of ring 151 will be generally the same as the outside radius of sidewall 16, and the radius of ring 145 will be greater than the radius of the sidewall 16. Furthermore, surface 150 of ring 147 will be oriented so that it would be generally concentric with and straddle the can end of an adjacent, stacked can having a can end without corresponding rings 147 and 153.

In one embodiment, creation of annular rim 142 is similar to creation of annular rim 28 discussed above regarding FIGS. 8*a*-8*d*, except that an outwardly directed force is applied to annular rim 58. In this embodiment, annular rim 142 extends from double seam 140 as shown in FIGS. 11-13*b* following application of the outwardly directed force. To configure can end component 72 to create annular rim 142, bead 54 may be positioned closer to the outer or peripheral edge of the can end component (e.g., closer to seaming panel 50) than when can end component 72 is configured to create annular rim 28. In another embodiment, annular rim 142 is formed from bead 54 during compression of double seam 140 into its final form. In one such embodiment, can end component 72 is held by a seaming chuck, and a first operation roller rolls around can end component 72 to partially compress the double seam between the first operation roller and the seaming chuck. Then, a second operation roller rolls around can end component 72 to complete compression of the double seam and to create annular rim 142. In this embodiment, the shape of the surface of the second operation roller that contacts the can end component determines the final shape and position of annular rim 142.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

It is important to note that the construction and arrangement of the container as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. In addition, the present disclosure encompasses any combination of the elements of various exemplary embodiments discussed herein. Accordingly, all such modifications are intended to be included within the scope of the present application. Other substitutions, modifications, changes and omissions may be made in the design, operating conditions and arrangement of the exemplary embodiments without departing from the scope of the present application.

What is claimed is:

1. A first container adapted to be stacked adjacent to a second container, the first container comprising:

a sidewall, the sidewall having a first end and a second end;

a first end wall;

a first seam coupling the first end wall to the first end of the sidewall, the first seam comprising:

a first seam inner segment extending in the longitudinal direction away from the first end wall;

a first seam outer segment; and a first seam shoulder segment, the first seam shoulder segment extending in the radial direction; and an alignment feature extending in the longitudinal direction away from the first end wall, the alignment feature comprising:

an alignment feature inner segment having an inner surface; and an alignment feature outer segment;

wherein the first end wall transitions into the first seam inner segment and the first seam inner segment transitions into the first seam shoulder segment;

wherein the first seam shoulder segment transitions into the alignment feature inner segment;

wherein the alignment feature inner segment transitions into the alignment feature outer segment;

wherein the alignment feature outer segment transitions into the first seam outer segment; and further wherein the alignment feature resists lateral movement of the first container relative to the second container via contact between the alignment feature inner surface and the second container, when the first container is stacked adjacent to the second container.

2. The first container of claim 1, wherein the alignment feature is adapted to align the first container relative to the second container such that the first seam shoulder segment is in contact with a seam of the second container when the first container is stacked adjacent to the second container, and further wherein the weight of the stacked containers is born through the contact between the first seam shoulder segment and the seam of the second container.

3. The first container of claim 1, wherein the alignment feature inner segment comprises:

an angled portion, the angled portion extending in the longitudinal direction away from the first end wall and extending in the radial direction; and a substantially vertical portion;

wherein the first seam shoulder segment transitions into the angled portion- and the angled portion transitions into the substantially vertical portion of the alignment feature;

wherein the substantially vertical portion transitions into the outer segment of the alignment feature.

4. The first container of claim 3, wherein the inner surface of the alignment feature inner segment includes both an inner surface of the angled portion and an inner surface of the substantially vertical portion.

5. The first container of claim 3, wherein the angled portion is a continuous curved portion.

6. The first container of claim 1, wherein the first seam shoulder segment includes a substantially horizontal shoulder that is in contact with a seam of the second container when the first container is stacked adjacent to the second container.

7. The first container of claim 1, wherein the alignment feature forms an annular rim extending from the first seam.

8. The first container of claim 7, wherein the annular rim is positioned between the first seam shoulder segment and the first seam outer segment such that a seam of the second container is received within the annular rim when the first container is stacked adjacent to the second container.

9. The first container of claim 8, wherein the outside diameter of the seam of the second container that is received within the annular rim is approximately three inches.

10. The first container of claim 1, wherein the first end wall, the first seam inner segment, the first seam outer segment, the first seam shoulder segment, the alignment feature inner segment, and the alignment feature outer segment are formed from a continuous first piece of metal.

11. The first container of claim 10, wherein the first seam is a double seam formed by compressing the material of the first seam outer segment with material of the sidewall.

12. The first container of claim 1, wherein the first end of the sidewall is a lower end of the sidewall and the second container is located below the first container when stacked.

13. The first container of claim 1, wherein the radius of an inner surface of the first seam inner segment is less than the radius of the inner surface of the alignment feature.

14. The first container of claim 1, wherein the first seam is a hermetic seam.

15. The first container of claim 10, wherein the sidewall is formed from a continuous second piece of metal.

16. A stackable, metal, first container adapted to be stacked on top of a second container, the first container comprising:

a metal sidewall formed from a first contiguous piece of metal, the sidewall having an upper sidewall end and a lower sidewall end;

a metal lower end wall formed from a second contiguous piece of metal;

a lower seam coupling the lower end wall to the lower sidewall end, the lower seam comprising:

a lower seam inner segment extending in the longitudinal direction away from the lower end wall;

a lower seam outer segment; and a lower seam shoulder segment, the lower seam shoulder segment including a substantially horizontal surface that faces away from the lower end wall; and an annular alignment rim extending from the lower seam in the longitudinal direction away from the lower end wall such that the alignment rim is positioned below the seam, the alignment rim comprising:

an alignment rim inner segment having an alignment rim inner surface; and an alignment rim outer segment;

wherein a peripheral portion of the lower end wall transitions into and is continuous with the lower seam inner segment and the lower seam inner segment transitions into and is continuous with the lower seam shoulder segment;

wherein the lower seam shoulder segment transitions into and is continuous with the alignment rim inner segment;

wherein the alignment rim inner segment transitions into and is continuous with the alignment rim outer segment;

wherein the alignment rim outer segment transitions into and is continuous with the lower seam outer segment;

wherein the lower sidewall end is folded in between the lower seam inner segment and the lower seam outer segment, coupling the sidewall to the lower end wall;

wherein the lower seam inner segment, the lower seam outer segment, the lower seam shoulder segment, the alignment rim inner segment and the alignment rim outer segment are formed from the second contiguous piece of metal; and further wherein the alignment rim resists lateral movement of the first container relative to the second container via contact between the alignment rim inner surface and the second container, when the first container is stacked adjacent to the second container.

* * * * *